US005100074A

United States Patent [19]

Jones

[11] Patent Number: 5,100,074

[45] Date of Patent: * Mar. 31, 1992

[54] AUTOMATED WIRE DISPENSER

[76] Inventor: Johnnie L. Jones, 5600 - 10 Mile Rd., N.E., Rockford, Mich. 49341-9552

[ * ] Notice: The portion of the term of this patent subsequent to Feb. 13, 2007 has been disclaimed.

[21] Appl. No.: 479,295

[22] Filed: Feb. 13, 1990

Related U.S. Application Data

[63] Continuation-in-part of Ser. No. 189,422, May 2, 1988, Pat. No. 4,899,945, which is a continuation-in-part of Ser. No. 881,849, Jul. 3, 1986, abandoned.

[51] Int. Cl.[5] ..... B65H 49/00; B65H 49/34; B65H 59/38; B65H 79/00

[52] U.S. Cl. ..... 242/45; 242/54 R; 242/58.6; 242/75.51; 242/78

[58] Field of Search ..... 242/45, 75, 75.51, 54 R, 242/58.6, 78, 78.1, 78.6, 79, 128, 129

[56] References Cited

U.S. PATENT DOCUMENTS 3,282,518 11/1966 Holmes ..... 242/54 R
3,476,330 11/1969 Curtland ..... 242/45
4,582,271 4/1986 Takahashi ..... 242/45 X
4,899,945 2/1990 Jones ..... 242/45

*Primary Examiner*—Stanley N. Gilreath
*Attorney, Agent, or Firm*—Price, Heneveld, Cooper, DeWitt & Litton

[57] ABSTRACT

A machine for dispensing wire according to the momentary needs of A wire utilizing device has a wire support means rotatably mounted thereon, the coil of the wire being coaxially supported on the member for rotation therewith. A wire accumulation means is mounted on a frame and includes a wire-engaging guide movable in relation to a predetermined direction to produce an accumulation loop in the wire. A control means is provided for producing a control signal transmitted to a regenerative motor controller which controls the rate of the wire feed as the wire supply requirements increase and decrease. The wire is guided from the coil by porcelain eyes having openings through which the wire easily fits to guide the wire to the accumulation means with minimum friction and wire bending.

7 Claims, 14 Drawing Sheets

AUTOMATED WIRE DISPENSER

CROSS REFERENCE TO RELATED APPLICATIONS

This application is a continuation-in-part of applicant's co-pending patent application, Ser. No. 189,422, filed May 2, 1988, now U.S. Pat. No. 4,899,945, issued Feb. 13, 1990, which is a continuation-in-part of Ser. No. 881,849, filed July 3, 1986, now abandoned.

BACKGROUND OF THE INVENTION

The present invention relates to automatic wire dispensing machines and more particularly to an automatic wire dispensing machine that is capable of dispensing wire from heavy spools under demanding conditions of use that include high rates of wire feed and intermittent and sporadic feed requirements. Such demanding uses are typical in wire spring forming machines and to a certain extent in automatic welding machines that use welding wire as a source of the metal forming the weld bead.

Many industrial operations require a substantially continuous supply of metal wire. An automatic spring making machine is one type of operation, and an automatic welding machine employing wire to form the weld bead is another type of operation. For exemplary purposes, the present invention will be described in connection with these types of operations, although it can be used in other types of operations as well.

In operations requiring a continuous supply of metal wire, the wire can be provided in a number of forms. It can be wound on a wooden spool or it can be packaged in a drum or loosely in a coil. The wire can be mounted for rotation and dispensation about a vertical or horizontal axis.

In order to maximize the efficiency of wire feeding operations, it is desirable t-o employ supply wire in large quantities; for example, a wire spool weighing up to one thousand (1,000) pounds or more is common. A large supply of wire minimizes the number of times that the spool has to be changed and handled and can provide efficiencies in purchasing the wire in larger bulk quantities.

Large spools of wire present special problems. Because of the inertia of a full spool, a substantial amount of force is required to start the spool rotating, and when wire usages stops, the inertia of the spool causes the spool to continue rotating and continue feeding wire. When relatively thin wire is coiled on a large spool, the problems are especially acute. A sudden start of the spool can break the wire. Moreover, excess tension in the wire can stretch it to the point of "necking down" to a reduced diameter and correspondingly reduce the diameter of the metal available for the metal forming operation. When a particular diameter of wire is accurately predetermined, it is undesirable to stretch the wire so that an inconsistently thinner wire is actually available for the operation.

Another problem with requiring a large pulling force to remove wire from a supply spool is that the wire can be wedged between adjacent coils on the spool and can become gripped tightly enough to resist pulling free of the spool. Further, the drive mechanism for the metal forming operation needs to grip the wire tightly in order to overcome the inertia of the spool, and in so doing the teeth of the drive mechanism can bite into the wire and affect the characteristics of the wire.

Still another problem with the use of a large wire supply spool is that the weight of the spool changes markedly as wire is withdrawn from the spool, reducing the weight of a fully loaded spool from one thousand (1,000) pounds to as little as thirty (30) pounds when the spool is empty. This presents a changing inertia force that affects the starting and stopping characteristics of the spool.

A number of machines have been developed to overcome these problems, but none have been completely successful. Most such machines employ some type of motorized mechanism for supplying the wire and a mechanical brake mechanism for stopping the spool when the wire supply is no longer required. Some machines provide tension control devices that are intended to match the feed rate with the utilization rate. Other machines provide slack wire loops that permit the machine using the wire to make rapid and intermittent use of the wire while providing the wire feed at a more continuous rate. Such machines often require frequent adjustment to accommodate different sizes of wires, different feed rates, different spool sizes, and changing spool weights due to the removal of wire from the spools. Even with continuous changes, such machines still are usually not capable of consistent and reliable performance.

It is an object of the present invention to provide an improved automatic motorized wire dereeler or dispenser that is simple to operate, compact, inexpensive, and accommodates a wide range of operating conditions without adjustment.

SUMMARY OF THE INVENTION

A wire-dispensing machine receives a coil of wire such as a spool of wire on a removable shaft. The shaft is rotated to cause the spool to pay out wire as a function of wire feed rate required by the feeding apparatus of the machine using the wire. This is accomplished by leading the wire in a non-linear path over a wire speed control mechanism comprising a wire guide that is movable by a differential between the wire feed rate and the wire use rate. The wire guide system is a biased pulley system arranged to form a variable size reserve accumulation loop in the wire. The wire guide resiliently deflects the wire into the loop from a straight line path that it would otherwise take in extending from the spool to the location where it is utilized. When an increased wire feed rate is called for, the wire starts to straighten out and moves the wire guide to decrease the size of the loop. When less wire is called for, the resilient bias in the speed control system causes the loop to become enlarged.

The spool is rotated by a variable speed drive mechanism that is controlled by a regenerative control mechanism, which is in return controlled by a control potentiometer responsive to the position of the movable wire guide. The regenerative controller provides an automatic adjustment-free control of motor speed and motor acceleration and deceleration rates. This eliminates the need for a mechanical brake, permits forward and reverse operation, and automatically compensates for changes in spool weight as wire is dispensed. A trim potentiometer in the controller provides additional adjustment flexibility to the control potentiometer. Zero movement in the wire leaves the spool non-rotative, but preferably with the drive mechanism partially energized. Passage of the end of the wire (or wire breakage) shuts down both the dispensing machine and the utilizing device to permit splicing.

The accumulation loop is sized to permit rapidly fluctuating wire feed rates while at the same time causing the regenerative controller to more gradually increase and decrease the motor speed. This more gradual acceleration and deceleration permits the use of a less powerful motor and a lighter drive train and avoids wire slack that lets the wire jump off the guide pulleys. While as little as about six (6) inches of accumulation can be satisfactory for very low feed rates and about one (1) foot of accumulation will accommodate a maximum speed of about seven hundred fifty (750) inches per minute (which satisfies many welding requirements), at least about two (2) feet and preferably about three (3) feet or more of accumulation is desired. This is sufficient to control acceleration and deceleration of the regenerative controller to desirable levels in systems requiring wire feed rates of two thousand (2,000) inches per minute with a DC motor of as little as one-half (½) horsepower or less. The required size of an accumulation loop drops as maximum speeds drop. Motor size and spool size also are factors, with larger motors and lighter spools requiring less of an accumulation loop.

A multiple pulley system providing multiples of at least about four (4) and preferably about six (6) foot accumulation loops is desirable for systems requiring higher intermittent feed rates, such as spring forming machines. An accumulation loop of at least about twelve (12) feet (two six-foot loops) is desired for providing wire at feed rates that approach four hundred (400) feet per minute (4800 inches per minute) on an intermitent basis. A third loop accumulation of eighteen (18) feet is even more preferred and can be required for even faster speeds.

The control system can be wired to provide for automatic forward and reverse rotation of a wire spool to dispense or rewind wire automatically.

The control potentiometer is a rotary potentiometer controlled by a drive belt connected to a pivotal control arm. This system provides adjustment flexibility while limiting stress on the potentiometer.

Wire spools of different sizes can easily be loaded in the dispenser and the motor can be pivoted easily to remove and install the drive belt to facilitate installation and removal of wire spools.

These and other features and advantages of the present invention are described in detail below and shown in the attached drawings.

DESCRIPTION OF THE PREFERRED EMBODIMENT

Figure 1:
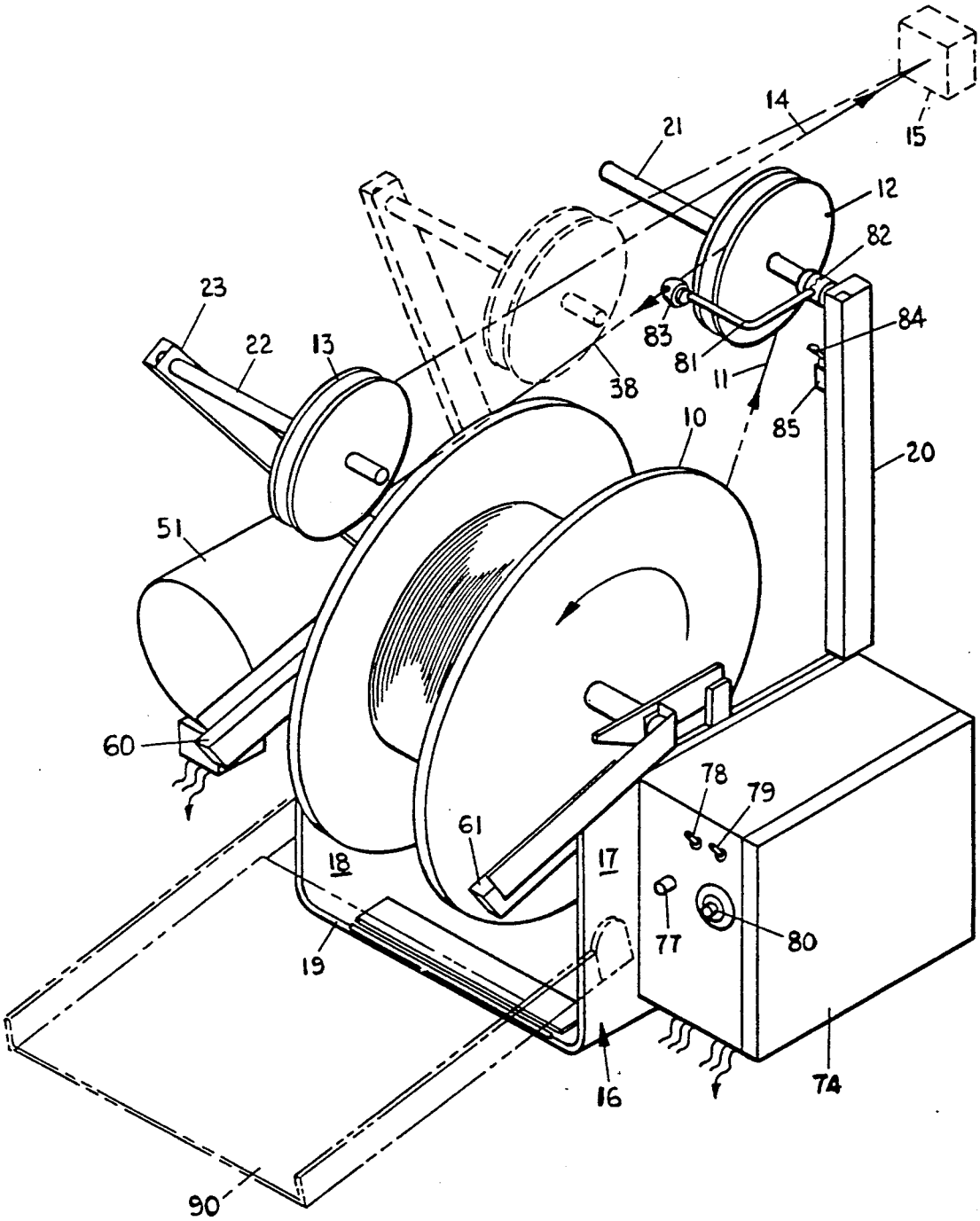
FIG. 1 is a perspective view showing the machine in operating condition.
Figure 2:
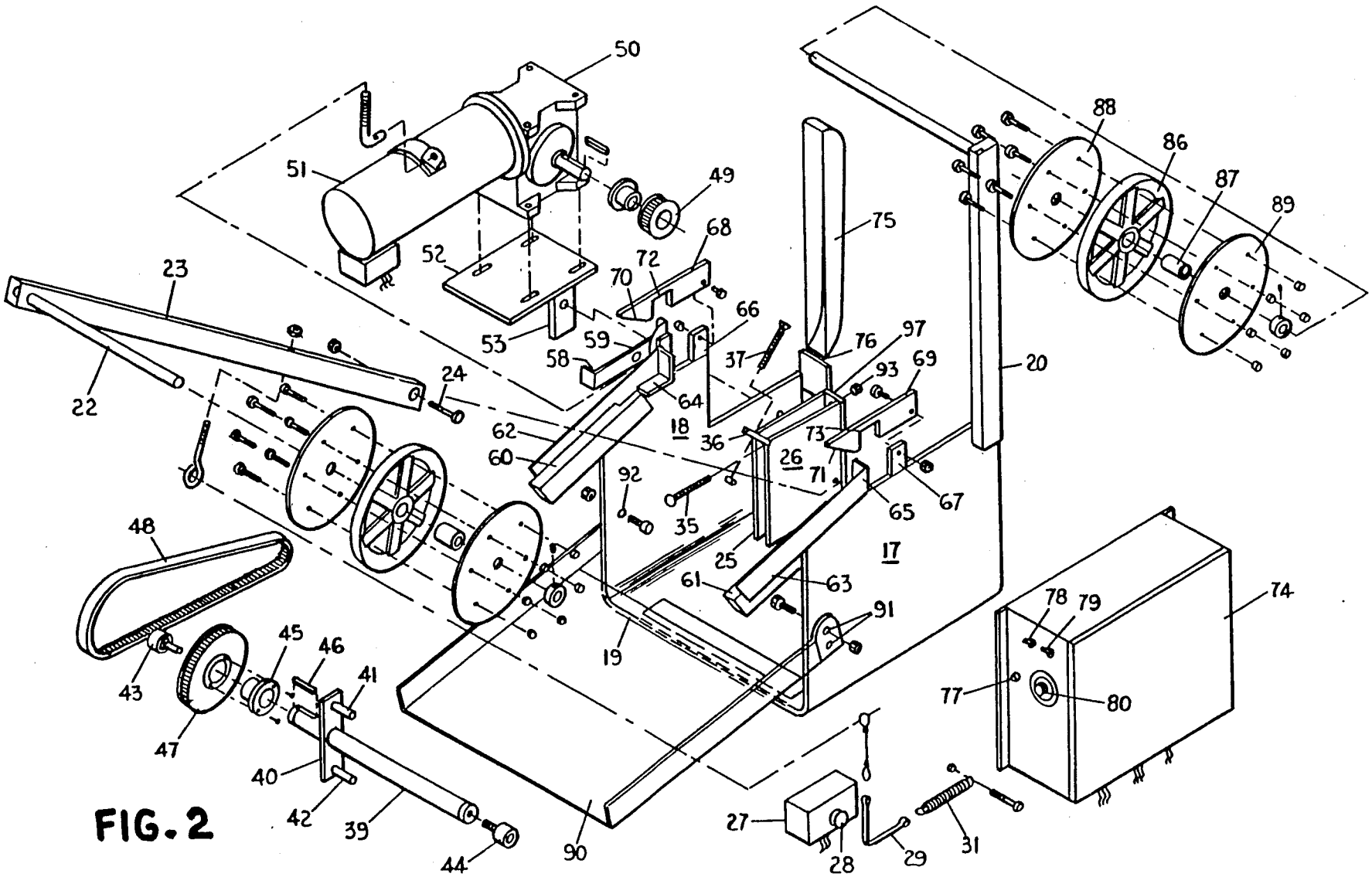
FIG. 2 is an exploded perspective view showing the components of the machine.
Figure 3:
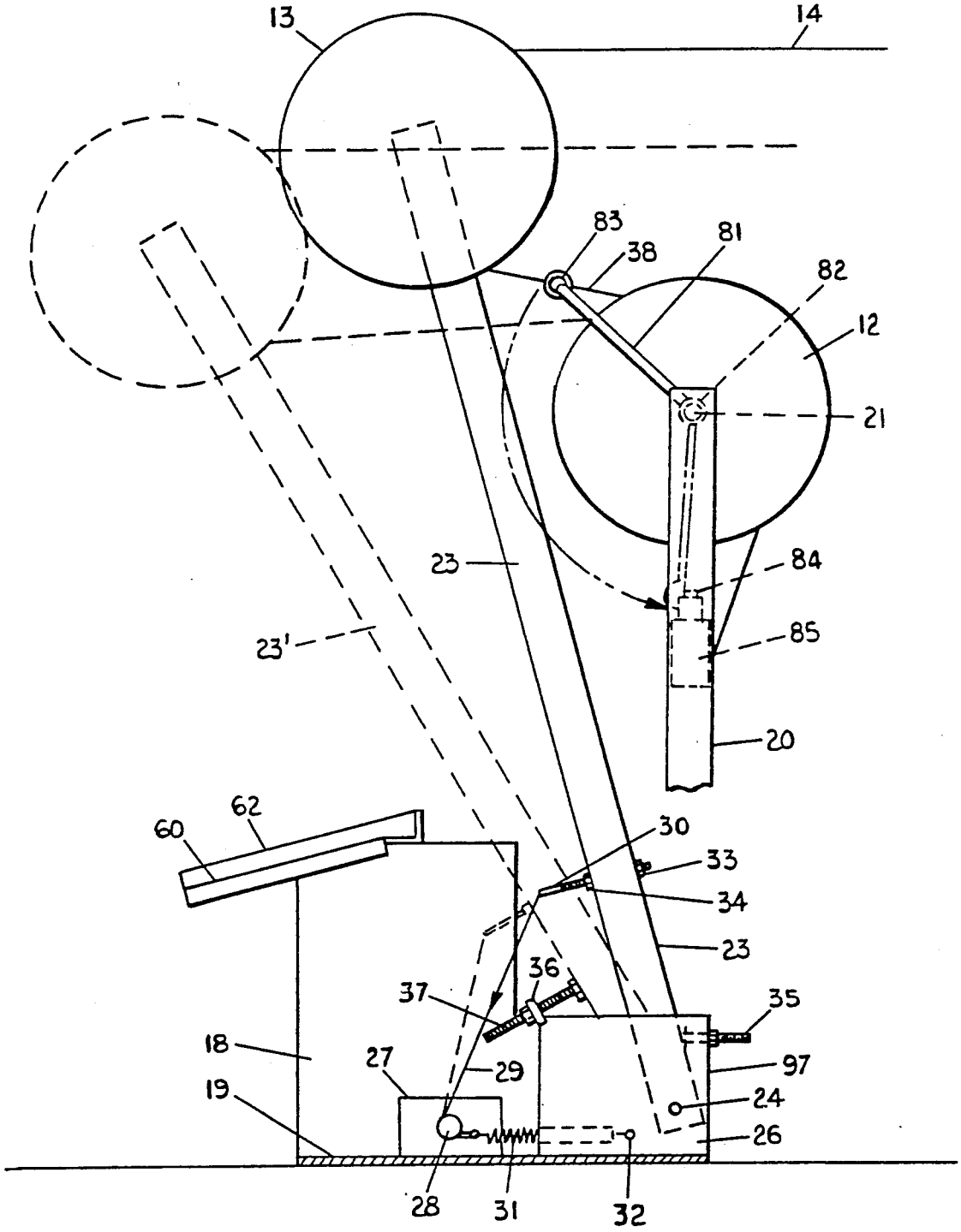
FIG. 3 is a side elevation in section, showing the tension-detecting system.

Referring to the drawings, a first embodiment of the invention is shown in FIGS. 1–4. The functioning of the machine pays out wire from the spool 10 along a path 11 determined by the wire-guide pulleys 12 and 13 to a line of utilization 14, which is a generally straight line path leading to a device 15, such as an automatic welding machine or an automatic spring manufacturing machine, with its own wire-feeding mechanism that pulls wire from the spool as needed. The machine has a U-shaped frame 16, formed by the vertical sides 17 and 18, and the bottom 19. The fixed vertical arm 20 is welded to the top of the side portion 17 of the frame, and supports the horizontal shaft 21 engaging the pulley 12. This pulley is preferably free to move back and forth axially along the shaft 21 to accommodate the changing position of the wire as it is drawn from the spool 10. The pulley 13 is similarly supported by the shaft 22 secured to the end of the arm 23 pivotally mounted on the bolt 24 (refer to FIGS. 2 and 3). The arm 23 is received between the parallel plates 25 and 26 welded along their bottom edges to the central portion 19 of the frame. The bolt 24 traverses these plates, as well as the arm 23. A potentiometer 27 is secured to the inside surface of the frame portion 18, as shown in FIG. 3. The potentiometer is actuated by a sprocket 28 and a toothed belt 29 extending from the terminal 30 on the arm 23 around the sprocket 28 to the return spring 31 secured at its opposite end to the plates 25 and 26 by the bolt 32. The spring 31 performs the function of resiliently retracting belt 29 and rotating potentiometer sprocket 28 counterclockwise (FIG. 3) when the arm 23 is moved to the left. The terminal 30 is preferably in the form of an eye-bolt, adjustably secured with respect to the arm 23 by the nuts 33 and 34.

The allowable sector of angular movement of the arm 23 is determined in an upward direction representative of an increased wire supply requirement by the adjustable stop bolt 35 which fits through plate 97 extending between. plates 25 and 26 and is held in place by nut 93. A small bracket 36 is secured to the plates 25 and 26 to form a support for another stop bolt 37, which limits the leftward movement of the arm 23 to the dotted line position shown in FIG. 3, representing a reduced wire supply requirement. It should be noted in connection with FIG. 3 that the adjustment of the stop bolts 35 and 37 establishes an outwardly inclined position of the arm wherein the center of gravity of the arm 23 (including the mass of the pulley 13) is at a position above and offset from the axis of the pivot bolt 24 such that the effect of the weight is a gravity bias to urge arm 23 to the left so as to enlarge the loop. With a gravity bias, the back tension on the wire does not increase as the arm pivots upwardly. In fact, the tension caused by the gravity bias decreases. Thus, the present control is a true speed control device and not a tension control device. The force of gravity can be augmented by a spring for heavier wire. The position of this center of gravity establishes the threshold tension in the wire 14 required to actuate the motor drive by moving the arm 23 from the dotted line 23' position toward the full line position in FIG. 3. With an arm about forty-seven (47) inches long and weighing about four and one-half (4½) pounds, the freedom of movement of the arm 23, as viewed in FIG. 3, should be within a sector extending from an inclination of about five to ten degrees (5°–10°) to a maximum backward or outward inclination with respect to a vertical line of approximately thirty degrees (30°) or so, so that it creates an accumulation arc about eighteen (18) inches long. This freedom of movement establishes sufficient bias to maintain a preferred wire tension adjustment of about eight (8) ounces for initial withdrawal of wire and two (2) to four (4) ounces for continuous withdrawal, while maintaining an adequate reserve loop of wire of at least about two (2) feet and preferably about three (3) feet or so (the term "reserve loop" or "accumulation loop" meaning the amount of wire that is withdrawn in moving pulley 13 between its arcuate extremes without rotating the spool wire). On a sudden demand for wire, this loop can shorten from the full line to the dotted line positions, and thus decrease the necessary acceleration of the spool. A sudden decrease in demand can be taken up by an increase in the amount of wire involved in this loop. The angle and size of arm 23 can be varied (or a spring can be incorporated) to alter the tension necessary to withdraw wire from the spool. The tension range should be between one-half (½) ounce and six (6) pounds. Desirably, the tension in the wire should be higher for starting spool rotation than for continuous running, but should not increase with increased wire supply speed.

The spool 10 is mounted on the shaft 39, and installation of the spool is accomplished by merely slipping it over the right end of the shaft 39 as shown in FIG. 2. A transverse plate 40 is welded to the shaft 39, and carries the studs 41 and 42 which engage conventional holes in one side of the standard spool. This coupling provides a torque transfer such that the rotation of the shaft 39 carries the spool with it. The opposite ends of the shaft 39 are provided with rollers 43 and 44 of a type commonly referred to as "cam followers", which are in the form of a bolt having the head configured to function as the inner race of a bearing. The outer diameter of the rollers desirably are no greater than the diameter of the shaft 39 or at least the hole in the spool so that the rollers fit through the axial opening in the spool when mounting the spool on the shaft. The outer race forms the rotatable surface, and the unit is normally in threaded engagement with the ends of the shaft. This arrangement provides for the free rotation of the shaft with respect to the support surface 64 on which its weight is carried. At the left end of the shaft, as viewed in FIG. 2, an adaptor 45 is engaged with a key 46 for transferring torque from the driving wheel or sprocket 47, which receives the toothed belt 48. This belt also engages the driving wheel or sprocket 49 of the speed-reducer 50 driven by the DC motor 51 (refer to FIG. 4). The motor and speed-reducer form a single unit, which is mounted on the platform 52 provided with a downwardly-extending bracket 53 pivotally connected by the bolt 54 to the side portion 18 of the frame. The top of the motor is provided with a bracket 55 engaged by the hook 56 in transverse threaded engagement with the pivot stud 57 on the lever arm or toggle arm 58 mounted on the pivot pin 59 secured to the side portion 18 of the frame. In the elevated position of the toggle arm 58 shown in full line in FIG. 4, the hook 56 forms a link that can pass over center with respect to the pivot 59, and is adjusted to elevate the motor to the position shown in full lines from the position indicated in dotted lines. In the full line position, full tension is present in the drive belt 48. Rotation of the toggle arm 58 in a clockwise direction to its dotted line position lowers the motor to the corresponding dotted position establishing sufficient slack in the belt 48 to permit installation and removal of the belt on and off the end of sprocket 49 along with the installation or removal of a spool.

Figure 4:
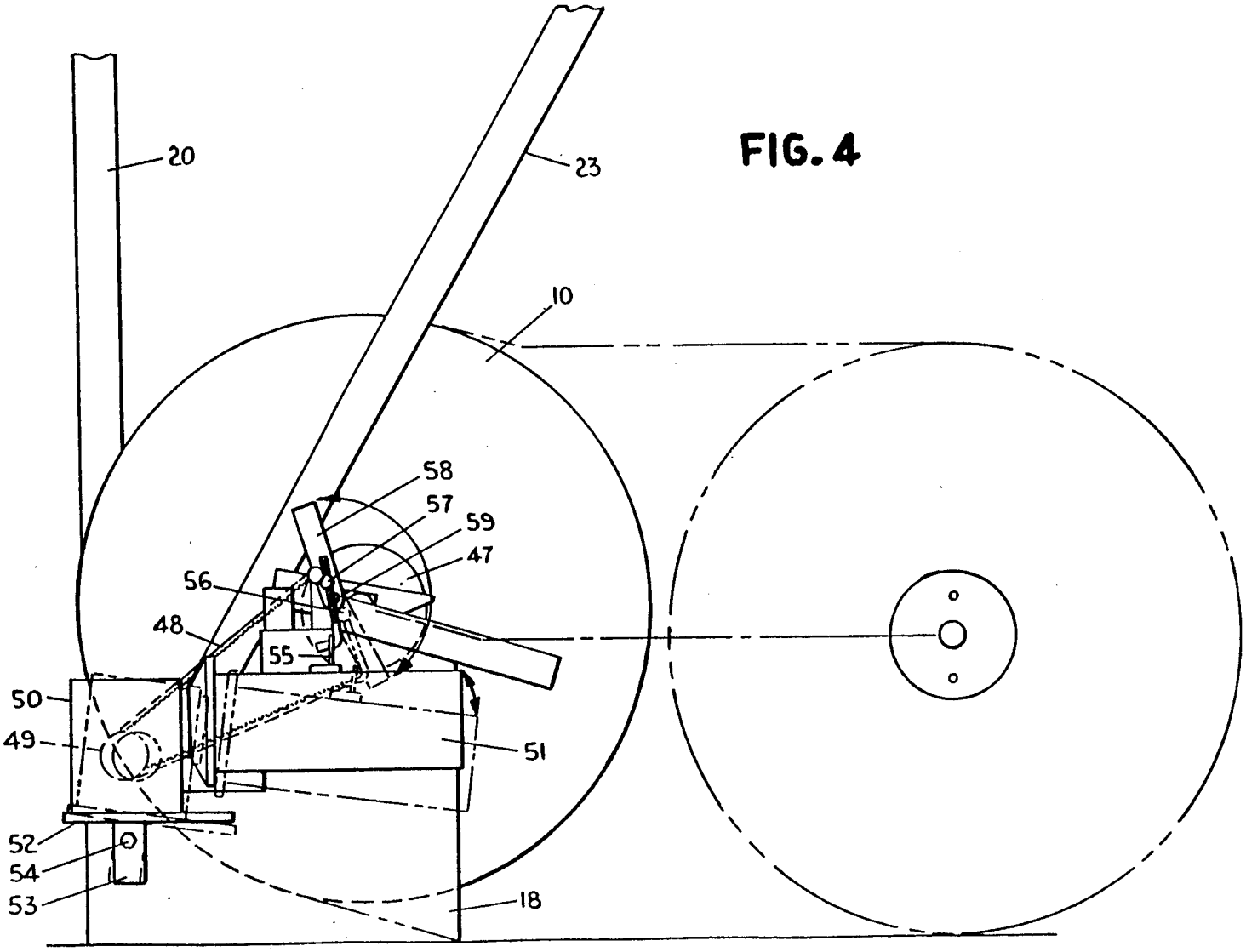
FIG. 4 is a side elevation showing the drive mechanism and the tension-release system permitting the spool to be installed and removed.

The installation of a spool involves moving it from a dotted line position shown in FIG. 4 to the full line position. To accomplish this, the shaft 39 is installed as previously described and the spool then rolled to the left, as shown in FIG. 4. The spool is manually lined up laterally so that the opposite ends of the shaft represented by the rollers 43 and 44 are disposed opposite the ramp rails 60 and 61. These rails are provided with side fences or upright portions as shown at 62 and 63 to confine the shaft (and the spool carried by it) against lateral or axial displacement. The assembly of spool, shaft, and sprocket is then simply rolled or pushed up the rails, the spool riding on the ground and the end rollers 43 and 44 being guided by rails 60 and 61, until these rollers arrive at the receptacles or support surfaces indicated at 64 and 65, which preferably are slightly downwardly inclined from the ramp to a closed end. The side portions 17 and 18 of the frame are provided with vertical extensions as shown at 66 and 67 forming brackets for receiving the latch arms 68 and 69 with pivot connections. These arms have cam surfaces as shown at 70 and 71, which are engaged by the rollers as they move upward into the receptacles. This action elevates the latches so that continued movement of the shaft 39 onto the receptacles reaches the point where the latch arms can drop down over the rollers 43 and 44 at the notches 72 and 73. Once this has happened, the spools are solidly locked in engagement with the machine. The belt 48 is then installed as previously described. It may be noted in passing that engine timing belts function very well as the drive belt 48. During the operation of the machine, the cover 75 hinged to the frame at 76 will be swung counter-clockwise, as shown in FIG. 2, down to cover the moving belt 48. The cover can be pivoted out of the way to facilitate installation and removal of a spool Referring to FIG. 1, the box 74 provides a housing for a motor controller system (preferably of the regenerative type) adapted to receive the low-amperage control signal from the potentiometer 27 and convert it to a controlled DC power supply for the motor 51 The box 74 also contains a few controls and adjustments for the electrical circuit. A fuse holder is indicated at 77, and the toggle switch 78 is an optional feature adapted to reverse the rotation of the motor whenever it may be desired to rewind the spool The toggle switch 79 establishes an off-on and start condition for the entire system. The control knob 80 is an important adjustment. This knob is associated with a trim potentiometer in series with the control potentiometer 27. The adjustment of the knob 80 thus controls the maximum magnitude of the controlled power supply signal established by a given degree of movement of the arm 23. This makes it possible to vary the incremental and maximum motor speeds over the range of rate variations provided by the movement of arm 23.

The regenerative controller is adjusted so that when wire usage stops the energization of the motor falls just below the point necessary to cause rotation of the motor prior to the engagement of the arm 23 with the stop bolt 37. Leaving the motor partially energized decreases the response time required for rotation to begin again on resumption of wire tension. Adjusting the system in this fashion requires less movement of the potentiometer to begin rotation of the motor, and eliminates the time that would be required for a gradual development of torque required to overcome friction. A potentiometer normally has a "dead spot" at which it passes no current. This decreases the available rotation of the potentiometer from an otherwise full three hundred sixty degrees (360°). The dead spot is positioned such that the potentiometer is in the dead spot when the control arm rests against stop bolt 37. By having the motor stop before arm 23 hits bolt 37 and the potentiometer dead spot, the potentiometer does not have to be rotated out of this dead spot in order to energize the system. The stop bolt 35 is adjusted to keep the potentiometer from entering the dead spot from the direction corresponding to increased wire supply speed. Experience has shown that this arrangement of potentiometers provides a vastly superior performance to other detector systems such as those involving electric eyes and rotatable perforated disks, or proximity detectors.

In the preferred embodiment of the present invention, an automatic shut-off mechanism for shutting off the wire-utilizing device 15 along with the illustrated wire-dispensing machine is actuated by a detector 81. This detector is essentially a radius arm extending from the hub 82 rotatably mounted on the shaft 21. The radius arm 81 has an angular configuration permitting it to reach around the area of possible axial movement of the pulley 12. The outer end of the arm carries the insulator 83 through which the wire is threaded. The insulation is important, as the wire is frequently subject to substantial electrical charge as a result of being associated with an automatic welding machine. The arm is maintained in the position shown in FIG. 1 by the tension of the wire, and failure of this tension permits the arm to drop down so that it engages the actuator 84 of a double-circuit switch 85. One section of this switch controls the illustrated dispensing machine, and the other is associated with the utilization device 15. As a result of frequent factory conditions, the utilization device may be at a very considerable distance from the dispensing machine, requiring the wire to be fed through a long conduit. The instant shut down of the utilization of the wire as the end of the spool is reached permits a new spool to be installed, with the end of the wire tied on to the tail of the previous wire supply, so that the wire can be drawn through the conduit, rather than laboriously fed through from one end. The conventional wiring associated with the system has been omitted for clarity. Experience has shown that it is usually not necessary to provide for axial movement of the hub 82 along the shaft 21 to accommodate the lateral movement of the wire. In some spools, such accommodation might be necessary. In such a case, the insulator 83 is best replaced by an elongated insulating plate with a slot sufficient to accept whatever lateral movement of the wire may be involved.

The construction of the pulleys also reflects the fact that the wire is often significantly charged. Both pulleys have essentially the same construction, and include a central wheel 86 usually of die-cast material, and thus highly conductive. This wheel is shielded electrically from the shaft by the insulating bushing 87, and the side plates 88 and 89 are also of insulating material. These are secured to the wheel 86 by conventional fastenings as shown.

The dispensing machine should be capable of handling spools of varying outside diameters, the most conventional sizes having diameters of twenty-two (22), twenty-six (26), and thirty (30) inches, the spools having core diameters typically of twelve (12) or fourteen (14) inches. The larger spools can weigh one thousand (1,000) pounds or so when fully loaded. Smaller spools can weigh as little as two hundred fifty (250) pounds or somewhat less. It is desirable for the spool to roll up to a position where the ends of the shaft 39 readily engage the support surfaces 64 at the upper ends of rails 60 and 61, with the spool being rollable on the ground by rotating the rim of the spool. If the spool were lifted off the ground by rails 60 and 61 at a point substantially before the support surfaces, the spool would have to be slid up the rails, and rotation of the rim would only cause the spool to rotate and would not create a force directing the spool inward into the frame. Positioning the rails and support surfaces so the leverage of the rotating rim can be used to roll the spool onto the support surfaces facilitates loading the machine. The machine can be accommodated to spools of less diameter by the use of the inclined trough or ramp 90 pivotally connected to the side portions 17 and 18 of the frame as shown at 91 and 92 with conventional bolts. A plurality of holes can be provided in the connecting portion of the trough to accommodate several different variations in spool diameter. The holes are provided typically for 22 and 26 inch spools. The ramp is removed for a thirty (30) inch spool.

The motor controller arrangement is an important aspect of the present invention. The motor controller comprises a variable speed control that converts a one hundred fifteen (115) volt AC signal to a continuously variable DC signal ranging from zero to ninety (0–90) volts, which in turn powers the DC motor 51. For heavier systems a controller that converts a two hundred twenty (220) volt AC signal to a zero to one hundred eighty (0-180) volt DC signal can be employed. The trim potentiometer 80 on the motor controller varies the maximum output voltage from zero to ninety (0-90) volts. The control potentiometer 27 provides a low voltage control input signal to the variable speed controller. In the present invention, the control signal varies between zero and ten (0-10) volts, and this variation causes a resultant variation in the output signal of the controller between its minimum and maximum values, depending upon the setting of the trim potentiometer. Thus, if the trim potentiometer is set at its full value, variation in voltage in the control potentiometer of zero to ten (0-10) volts causes a variation in the output signal of the motor controller from zero to ninety (0-90) volts, or from minimum to maximum motor speed. With this arrangement, the control potentiometer does not need to carry the load current to the motor but merely provides a control signal that is in effect amplified in the motor controller.

The use of a control potentiometer and a trim potentiometer at the same time provides additional adjustment advantages in the present invention. In different applications, it is desirable to provide different rates of acceleration and deceleration of the DC motor with varying ranges of movement of the pivoting control arm. When a large range of motion of the pivoting control arm is desired for achieving a small voltage change, the trim potentiometer can be reduced to a lower value. This will produce a lower voltage differential between the maximum and minimum arcuate positions of the control arm. The converse is present when the trim potentiometer is increased to its full value.

An important aspect of the present invention is that the motor controller is of the regenerative type. While a half-wave regenerative motor controller can provide acceptable results, a full-wave regenerative motor controller is especially desired from a durability standpoint. A regenerative motor controller is a commercially available product and has distinct advantages over conventional DC motor controllers when used in the combination of the present invention. A conventional DC motor controller controls the current to the DC motor in such a way that when the control signal is reduced to zero, the motor tends to coast. Thus, with a conventional DC motor controller it is necessary to use either a dynamic brake circuit in the motor drive or a mechanical brake to stop a spool when the motor is cut off. A mechanical brake adds expense and decreases the reliability of the system and the controllability of the deceleration rate. A dynamic brake, also called a resistance brake, causes the motor to act as a fixed torque brake. Such a brake applies essentially the same braking force to the spool at all times and does not automatically modify the braking force to accomodate a change in weight of the spool as the wire is dispensed.

A feature of a regenerative motor controller is that when a decrease in speed is indicated, the controller generates a reverse torque in the DC motor that causes the DC motor to decelerate the load at a predetermined rate of deceleration, without the addition of a mechanical or dynamic brake. Moreover, a regenerative controller applies a varying torque and attempts to accelerate the spool and decelerate the spool at constant rates, regardless of the weight of the spool. Additionally, the regenerative controller is internally adjustable to separately control the acceleration and deceleration rates. After considerable effort, applicant was able to harness a regenerative motor controller to operate the automatic wire dispenser of the present invention at tolerable acceleration and deceleration rates.

In this connection, it is an important aspect of the present invention that the invention employ an accumulation loop with a sufficient amount of wire to permit gradual acceleration and deceleration of the spool as the need for increased wire supply is indicated. Without an accumulation loop, the regenerative motor controller attempts to start and stop the spool as quickly as needs change, and the result can be sudden acceleration and deceleration torques that cause severe stress on the motor and drive train and sometimes makes the wire jump off the pulleys. In order to provide rapid changes in drive speed that match rapid changes in wire supply requirements, a large DC motor is required, and much more substantial components are required in the drive train. By providing a substantial accumulation loop, rapid transitions in wire supply requirements can be supplied by surplus wire stored on the accumulation loop, and the regenerative control can cause a more gradual increase in motor speed to supply the increased supply requirements.

The same holds true when wire demand rapidly drops off. The accumulation loop can gradually increase to store the over-supply of wire until the motor gradually slows to match the wire supply speed with the requirements. For this reason, it is considered critical that there be a substantial amount of accumulation available when the present invention employs a regenerative motor controller. The only exception is when very light spools are used or when the wire feed rate is constant or is sufficiently low such that changes in spool speed do not present a problem.

In the present invention, when the dereeler is to have the capacity to provide wire from a one thousand (1,000) pound spool at varying speeds up to and including two thousand (2,000) inches per minute, the machine should provide an accumulation loop of at least about two feet and preferably about three feet or more. An eighteen (18) inch arc in the preferred embodiment provides an accumulation loop of about thirty-six (36) inches. This is sufficient to permit varying rates of wire use while automatically controlling acceleration and deceleration to desirable limits.

The present invention thus can power a one thousand (1,000) pound spool of wire at varying speed up to two thousand (2,000) inches per minute with a DC motor of one-quarter ($\frac{1}{4}$) to one-half ($\frac{1}{2}$) horsepower (with corresponding lighter drive train components), whereas a motor having at least one horsepower and much sturdier drive train components are required when the motor is required to match spool speed with widely varying feed requirements without a substantial accumulation loop.

The inherent braking capacity of a regenerative motor controller provides a very important advantage in the present invention. The braking torque or braking force necessary to provide a given rate of deceleration with a wire dereeler is dependent upon the amount of wire remaining on the spool. While the spool may start out weighing one thousand (1,000) pounds and require a very substantial braking force, as the wire is fed off the spool, the weight of the spool can drop gradually to about thirty (30) pounds. The lighter spool requires a smaller braking force. With a conventional mechanical brake, it can be necessary to adjust the brake continuously depending upon the amount of wire remaining on the spool. With a regenerative controller, on the other hand, the controller automatically generates a braking torque to achieve a given rate of deceleration, regardless of the weight of the spool. No adjustment is necessary, therefore, as a thousand pounds of wire is gradually dispensed from the spool. A greater braking force will automatically be applied to provide a specified deceleration rate when the spool is heavy, and the torque necessary for achieving this deceleration rate will automatically be reduced as the weight of the rotating load is reduced. This provides a significant advantage in performance. If spool stoppage is too fast, components can be damaged. If spool stoppage is too slow, the wire can become slack and jump off the feed pulleys.

The converse is also true with respect to start up or acceleration of the spool of wire, with the regenerative controller causing a substantially uniform rate of acceleration regardless of the amount of wire on the spool. This feature of the present invention eliminates many of the additional controls and much of the unreliability of prior wire dereelers.

Another significant feature of the regenerative controller is that it permits the automatic operation of the spool in both a forward and reverse direction. This is desirable when, for example, a welding arm or robot welder moves rapidly back and forth toward and away from the dereeler. To provide for forward and reverse movement of the spool, the control potentiometer can be rewired to the regenerative controller in a conventional way, with the control potentiometer being split for forward and reverse movement of the motor. The downward arc of the control arm 23 is increased from thirty degrees (30°) to forty reel (40°) to provide for about fifteen degrees (15°) movement in each direction, and the zero movement position is placed at the middle or center of the arc. Movement of the arm in a forward or upward direction causes the control potentiometer to transmit a zero to five (0–5) volt forward motion control signal to the controller. When wire usage stops, the arm returns under gravity to the zero point. At that point, the controller causes the motor to stop the spool so that the control arm remains in the centered spot. When reverse movement of wire occurs, the control arm pivots downward and the control potentiometer transmits an increasing zero to five (0–5) volt reverse movement control signal to the controller. The controller reverses the torque on the DC motor and reverses its direction.

The stop bolt 37 is positioned in the potentiometer dead spot with this set up in the same manner as the forward only set up. With this arrangement, if the wire breaks, the control arm falls all the way to stop bolt 37. The control potentiometer thus rotates past the maximum reverse speed into the dead spot on the potentiometer, shutting off the motor.

While the embodiment of the present invention disclosed in FIGS. 1–4 provides a satisfactory amount of wire accumulation to accommodate rapidly fluctuating wire supply requirements ranging from zero to two thousand (0–2,000) inches per minute, when higher wire feed requirements are present, a greater amount of wire accumulation is necessary in order to maintain acceleration and deceleration rates within desirable limits that permit use of lighter components and less powerful motors while restraining the wire from jumping off the pulleys during deceleration. For this reason, a second embodiment of the present invention disclosed in FIGS. 5–10 was developed. This embodiment is particularly advantageous for supplying wire to spring manufacturing operations, wherein short term wire supply requirements of up to four hundred (400) feet per minute (4800 inches per minute) or more can be encountered. Wire winding machines operated at a rate of ten thousand (10,000) inches per minute or faster also can desirably use this embodiment of the invention.

The second embodiment of the present invention is substantially the same as the first embodiment of the present invention, with the exception of the sheave or pulley arrangement used to dispense wire from the reel. Discussion of common features of the two embodiments will not be repeated.

Figure 5:
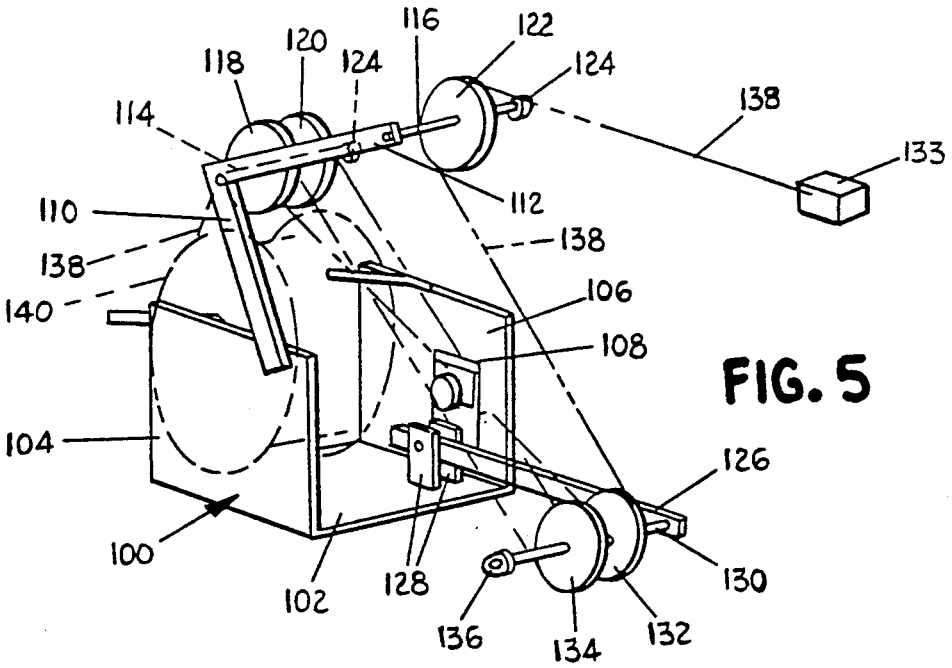
FIG. 5 is a perspective view of a second embodiment of the present invention.

As shown in FIG. 5, a high speed wire dispenser 100 comprises a frame having a base 102 and spaced upright sides 104 and 106 positioned on opposite sides of the base. Desirably the frame is formed of a solid plate bent into a U-shaped configuration, with an opening 108 being formed in side 106 so that the drive components can protrude into the interior of the frame. The drive components are mounted on the outer surface of side 106 in the same manner as in the first embodiment.

A fixed arm 110 is mounted on one side 104 of the frame and extends upwardly and slightly rearwardly from a front upper portion of the side. In the preferred embodiment of the present invention, this arm is about thirty-two (32) inches long and extends rearwardly about ten to fifteen degrees (10°–15°). A second arm 112 extends forwardly from the upper end of arm 110 at approximately a ninety degree (90°) angle. Preferably 112 is about eighteen (18) inches long. Pulley axles or shafts 114 and 116 extend across the front of the frame from the upper end of arm 110 and from the outer end of arm 112 respectively. Sheaves or pulleys 118 and 120 are rotatably mounted on shaft 114, and a sheave or pulley 122 is rotatably mounted on shaft 116. Desirably the shafts 114 and 116 are about eighteen (18) inches long and extend across the width of the spool 140 mounted in the frame, the overall width of the frame desirably being about twenty (20) inches. Removable caps 124 can be mounted on the ends of the shafts in order to prevent the pulleys from coming off the ends of the shafts. Otherwise, the pulleys are free to move axially on their axles to maintain alignment with the wire coming off the spool.

A pivoting control arm 126 is mounted between a pair of upright support members 128 extending upwardly from the base of the frame. Desirably these are positioned about eight (8) inches from the front of the frame and extend upwardly about fourteen (14) inches. The pivoting control arm is pivotally mounted in the blocks about twelve (12) inches above the base of the frame. The pivoting control arm desirably is about thirty-two (32) inches long and is pivotally mounted in the support members 128 about three (3) inches from one end of the arm. A shaft or axle 130 extends across the front of the frame from the outer end of the arm. The shaft desirably is about sixteen (16) inches long. A pair of sheaves or pulleys 132 and 134 are rotatably mounted on the shaft, and an end cap 136 can be employed to retain the pulleys on the shaft.

Wire 138 extending from spool 140 is wound on the pulleys in the following manner. The wire is first wrapped over pulley 118 and then around pulley 134 and then around pulley 120 and then around pulley 132. Finally the wire is wrapped over pulley 122 and thereafter extends to the spring manufacturing machine 133 or other utilizing machine. With the machine constructed in accordance with the preferred dimensions discussed above, a dereeler machine provides two accumulation loops of approximately six (6) feet apiece, or a total accumulation of twelve (12) feet of wire. Thus, for a rapid acceleration of wire requirement, twelve (12) feet of wire may be rapidly removed from the accumulation loop while the regenerative controller causes a gradual increase in torque in the DC motor and a gradual acceleration of the heavy wire spool at a rate that avoids damage to the drive components and yet provides enough acceleration to supply wire at the rate required before the accumulation loop is exhausted. For faster rates of speed, it is possible to easily increase the accumulation capabilities of the machine at six (6) foot increments by simply adding additional pulleys on shafts 114 and 130. Thus, the maximum amount of accumulation can be increased indefinitely. For a higher maximum speed, this can be accomplished by simply increasing the size of the DC motor and increasing the size and capabilities of the other drive components correspondingly.

Figure 6:
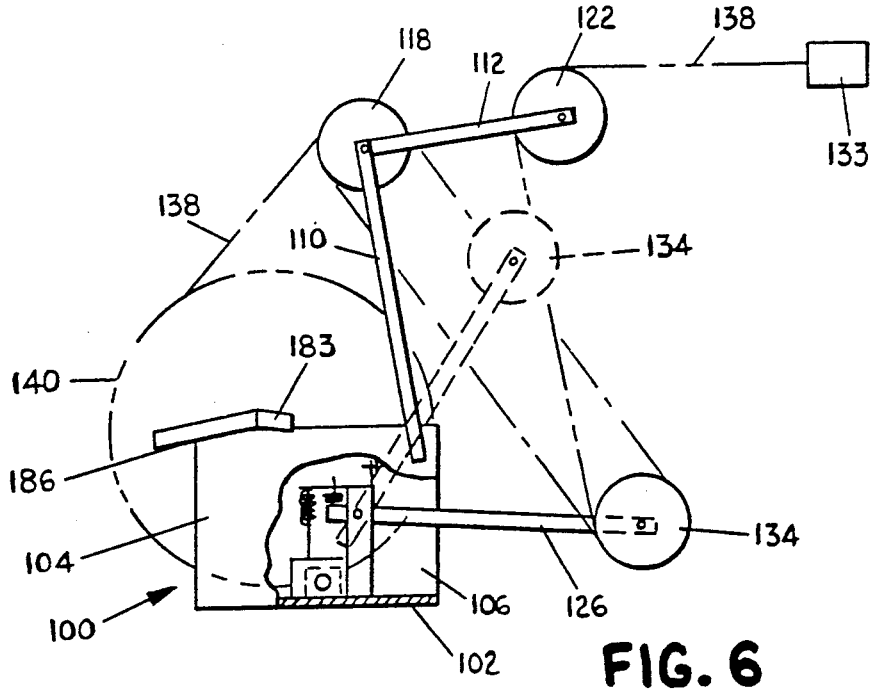
FIG. 6 is a side elevational view of the embodiment of FIG. 5, with a portion of the side broken away.
Figure 7:
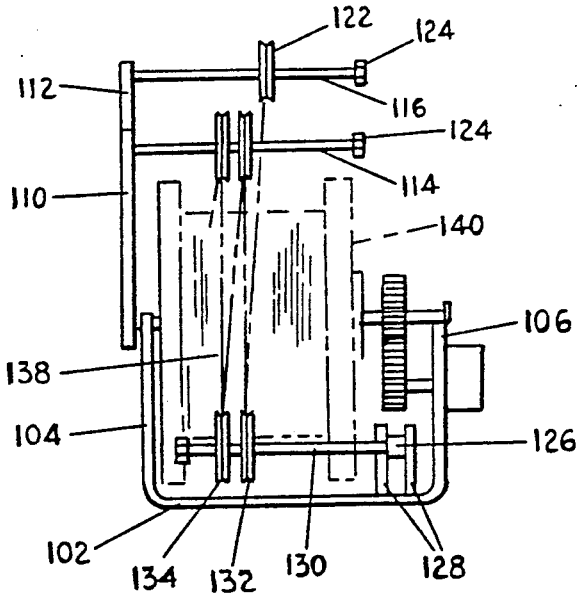
FIG. 7 is a front elevational view of the embodiment of FIG. 5.
Figure 9:
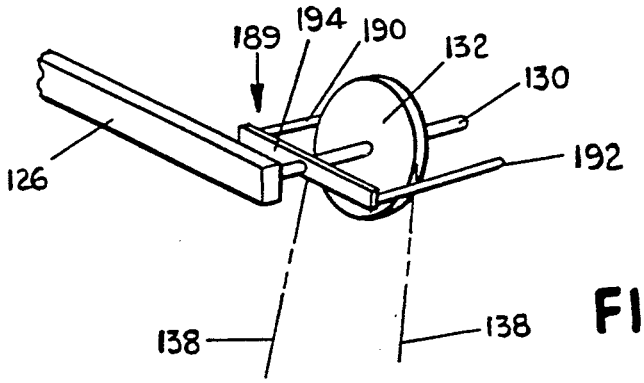
FIG. 9 is a fragmentary perspective view showing a wire retainer attachment for the present invention.

As shown in FIG. 6, the positions and dimensions of arms 110, 112, and 126 are such that when control arm 126 pivots upwardly to its uppermost position, the pulleys on the control arm move to a position that is approximately equidistant between the pulleys on shaft 114 and 116. This enhances the manner in which the wire is dispensed from the apparatus.

Figure 8:
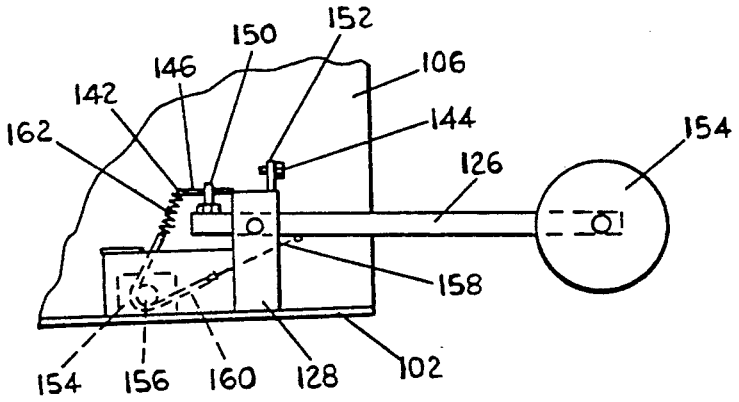
FIG. 8 is a partial sectional view of the embodiment of FIG. 5, showing the manner in which the pivoting control arm is mounted in the frame.

A more detailed depiction of the manner in which pivoting control arm 126 is mounted is shown in FIG. 8. Except for the fact that the control arm is mounted in a different position, the operative features of the control arm and the manner in which it serves to control the operation of the DC motor is the same as in the first embodiment. As shown in FIG. 8, the pivotal range of movement of control arm 126 is controlled by stops 142 and 144, each of which comprises a bolt threaded through a plate attached to the support structure. Bolt 142 is threaded through a plate 146 which extends horizontally across the top of the support members 128. A nut 150 serves to receive the bolt. The bolt can be turned to adjust the lowermost position of the control arm, which desirably is about horizontal or slightly below horizontal.

A vertical plate 152 extends between the top front edges of support members 128, and bolt 144 is threaded through the plate in the same manner as bolt 142. Bolt 144 stops upward rotation of the control arm at a point short of a straight vertical position, preferably at least five to ten degrees (5°–10°) or so away from a vertical position.

A control potentiometer 154 is mounted in an enclosure 155 adjacent the rear end of control arm 126 with its output shaft extending into the plane of rotation of control arm 126. A toothed wheel 156 is mounted on the end of the potentiometer output shaft. A cable 158 is mounted on the lower portion of arm 126 at a point outward of the point of pivotal attachment of the arm in the support members. Cable 158 extends to and is attached to one end of a toothed belt 160 that extends around wheel 156 of the potentiometer output shaft. The other end of belt 160 is attached to a spring 162 that is in turn attached to fixed plate 146. With this arrangement, when the control arm is pivoted upwardly, the interaction between the mating belt and toothed wheel on the potentiometer causes the potentiometer output shaft to rotate in a counterclockwise direction (FIG. 8 orientation), which is set up to cause an increasing voltage signal to be transmitted to the regenerative motor controller and in turn causes an increase in motor drive speed. When the arm pivots downwardly toward its rest position, the opposite occurs.

The mechanism for connecting the pivoting control arm to the shaft of the rotary potentiometer provides important advantages in the present invention. The toothed belt makes it possible to achieve any degree of rotary movement of the potentiometer with movement of the control arm through a limited arc. Thus, movement of the control arm through an arc of thirty degrees (30°) can rotate the potentiometer shaft three hundred sixty degrees (360°) if desired. The range of motion can be adjusted by changing the number of teeth on the potentiometer drive wheel.

Another advantage with this potentiometer actuation mechanism is that the control arm is not pivoted directly on the potentiometer shaft. A direct connection can cause stress on the potentiometer and limits potentiometer movement to the arc of the control arm. A timing belt type of connection is quite satisfactory in the present invention.

With this embodiment, it is also desirable that the motor remain partially energized in a standby mode even when wire requirements drop to zero. This can be accomplished with the regenerative motor controller of the present invention and maintains the motor in an energized but not actively rotating state, ready to immediately commence rotation of the motor without overcoming the inertia of a completely deactuated motor. This provides a steady and smooth acceleration of the spool and avoids the discontinuity that is present when an attempt is made to start a motor that is completely deactuated. Only when the wire is released or broken does the control arm fall to the point where the motor is actually deactuated. The braking ability of the regenerative controller makes it possible to hold the motor in this standby condition.

Figure 10:
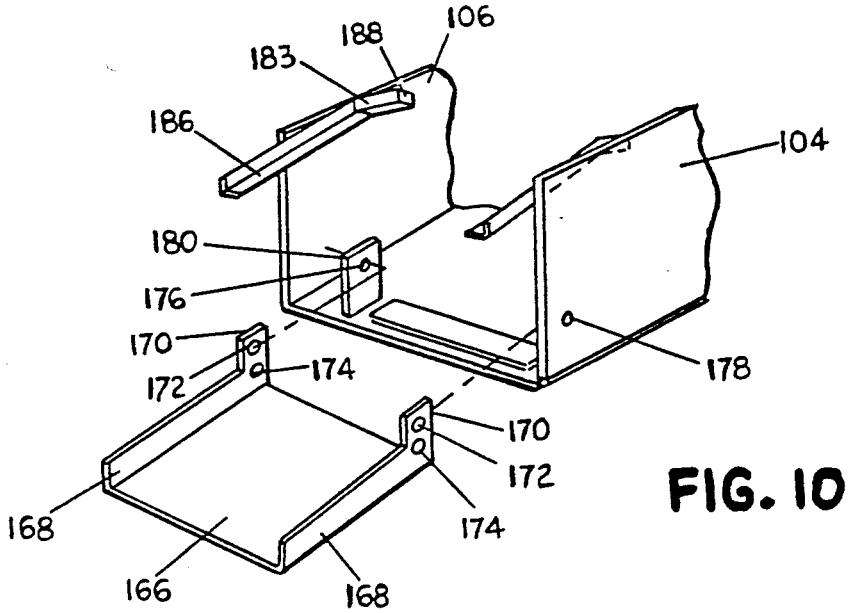
FIG. 10 is a fragmentary exploded perspective view showing the ramp mechanism employed with the embodiment of FIG. 5.

Referring to FIG. 10, a spool ramp 164 comprises a flat base plate 166 adapted to engage the outer rim of the spool, with side edges 168 extending upwardly therefrom. Side edges extend forwardly past the forward edge of plate 166 and thereafter extend upwardly, forming an upward tab 170 at the front end of edge 168. A pair of openings 172 and 174 are vertically spaced on each side tab 170. The ramp is attached as desired to the frame by mounting it between side wall 104 and an upstanding support 180. An opening 176 is provided in support 180 and an opposing opening 178 is provided in the side wall 104. Either opening 172 or 174 can be used to fasten the ramp to the frame. Opening 174 is employed to mount the ramp at its highest position, which is used for a twenty-two (22) inch spool. Opening 172 is employed for a twenty-six (26) inch spool. When the ramp is removed, a raised projection or strip 182 is employed for a thirty (30) inch spool. With a thirty (30) inch spool, the spool is rolled over strip 182 and thereafter the axle of the spool is suspended on the support surface 183 for the axle of the spool. The support surface is substantially horizontal or is preferably inclined slightly downwardly from the edge of upwardly inclined ramp 186, such that the axle will roll downwardly into abutment with closed rear end 188 of the support surface. A latch of the type shown in the previous embodiment (not shown in FIG. 10) holds the axle in place once it has rolled onto the support surface As with the previous embodiment, the loading mechanism is constructed so the spool is rolled on its rim almost to the point where the axle is on the support surfaces, facilitating the loading of the spool in the machine In high speed operations when the rate of wire feed increases rapidly, it is sometimes desirable to provide a means for holding the wire in the grooves on the sheaves. While this is generally not necessary with the present invention, when this is desirable, the apparatus shown in FIG. 9 can be employed. A wire retainer 189 for this purpose comprises a flat bar 194 with an opening therethrough through which one of the pulley shafts (130, for example) extends Shafts 190 and 192 extend outwardly from bar 194 adjacent the ends thereof, such that the shafts are positioned adjacent opposite sides of pulley 132. Bar 194 can be splined, keyed, fixed with a set screw, or otherwise securely fastened to shaft 130 in order to maintain the proper positions of shafts 190 and 192 on the outer sides of wire 138.

Figure 11:
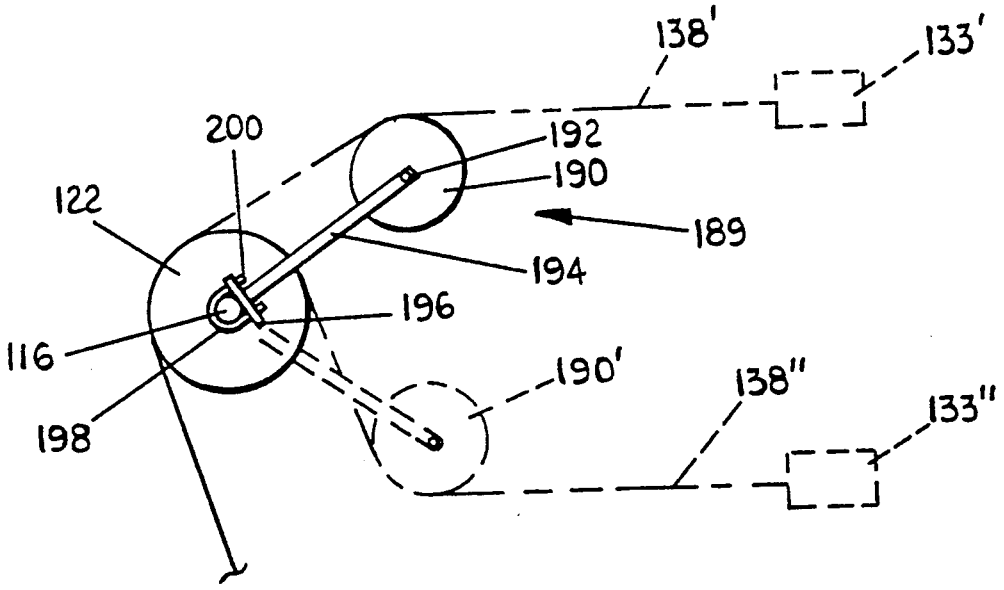
FIG. 11 is a side elevational view of one element of the accumulation loop pulley assembly, showing the use of an accessory pulley for varying the height of the wire at the point where it is dispensed.

Sometimes it is important that the wire leave the wire dereeling machine at the same level as the wire is used by machine 133. An accessory feature designed to discharge wire at a variety of elevations is shown in FIG. 11. A wire elevation control device 189 comprises a pulley 190 mounted by means of a horizontal axle 192 at the outer end of an arm 194. The inner end of the arm 194 is mounted by welding or the like on a transverse plate 196. Plate 196 is in turn fastened by two axially spaced U-bolts 198 to the same shaft 116 that pulley 122 is mounted. U-bolts 198 include nuts 200 that can be tightened to lock plate 196 at any radial position on shaft 116.

As shown in the drawings, pulley 190 can be locked in a raised position so that wire 138' will feed wire in an elevated position to machine 133'. Alternatively, arm 194 can be pivoted downwardly to the position shown in dotted lines, wherein pulley 190' feeds wire 138'' to machine 133'' at a lower elevation.

Figure 12:
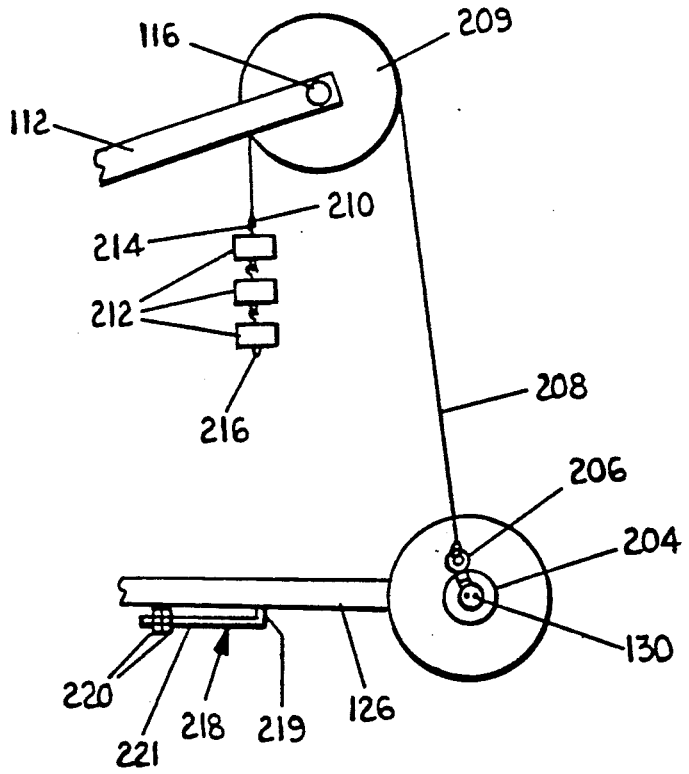
FIG. 12 is a fragmentary side elevational view of the accumulation loop pulley assembly showing a means for increasing and decreasing the weight of the pivoting arm.

A means for increasing and decreasing the effective weight of pivot arm 126 is shown in FIG. 12. In some applications, it is desired to increase or decrease the wire tension created by the pivot arm assembly. This is done by means of the apparatus shown in FIG. 12. In order to lighten the effective weight of the pivot arm 126, a collar 204 is rotatably mounted on shaft 130. An eye bolt 206 is fastened in the collar. A cable 208 extends upwardly from the eye bolt around another pulley 209 mounted on shaft 116. The cable extends over the pulley and downwardly to a loop 210 at the end of the cable. One or more weights 212 are attached to the end of the cable by means of a hook 214 at the top of the weight. A loop 216 is formed in the bottom of each weight, so that it will receive a hook 214 at the top of the weight fastened on the bottom. Three weights are shown in the exemplary embodiment. This structure is used to lighten the effective weight of the pivoting arm mechanism. Typically, weights 212 would be about 2 pounds apiece.

In order to increase the weight of arm 126, a right angle arm 218 is attached to the bottom of arm 126. Arm 218 includes a leg 219 extending perpendicularly from arm 126 and a leg 221 attached at one end to leg 219 and extending parallel to arm 126 to a free end. One or more weights 220 can fit on the free end of leg 221 and then can be attached by a set screw or the like. These weights will increase the effective weight of arm 126 and will thereby increase the tension in the wire being dispensed by the dereeling machine.

Additional embodiments of the present invention are shown in FIGS. 13–23. The principal difference in these embodiments is that the wire coils, instead of being mounted on edge are mounted on the horizontal platform for rotation about a vertical axis. When heavy spools of wires are used, the FIG. 1 embodiment conveniently provides a way to roll the spool into the wire dispensing device. When the weight of a heavy spool of wire is not the overriding consideration, it is sometimes convenient to orient the wire coils horizontally for rotation about a vertical axis. This makes it possible to dispense wire that is provided in forms other than spools, such as wire stored on a stem or catchway coil, wire provided in a basket, loose-packed wire, and loose-packed wire in a tub. Depending upon the application, wire could be provided in any of these common forms.

Figure 13:
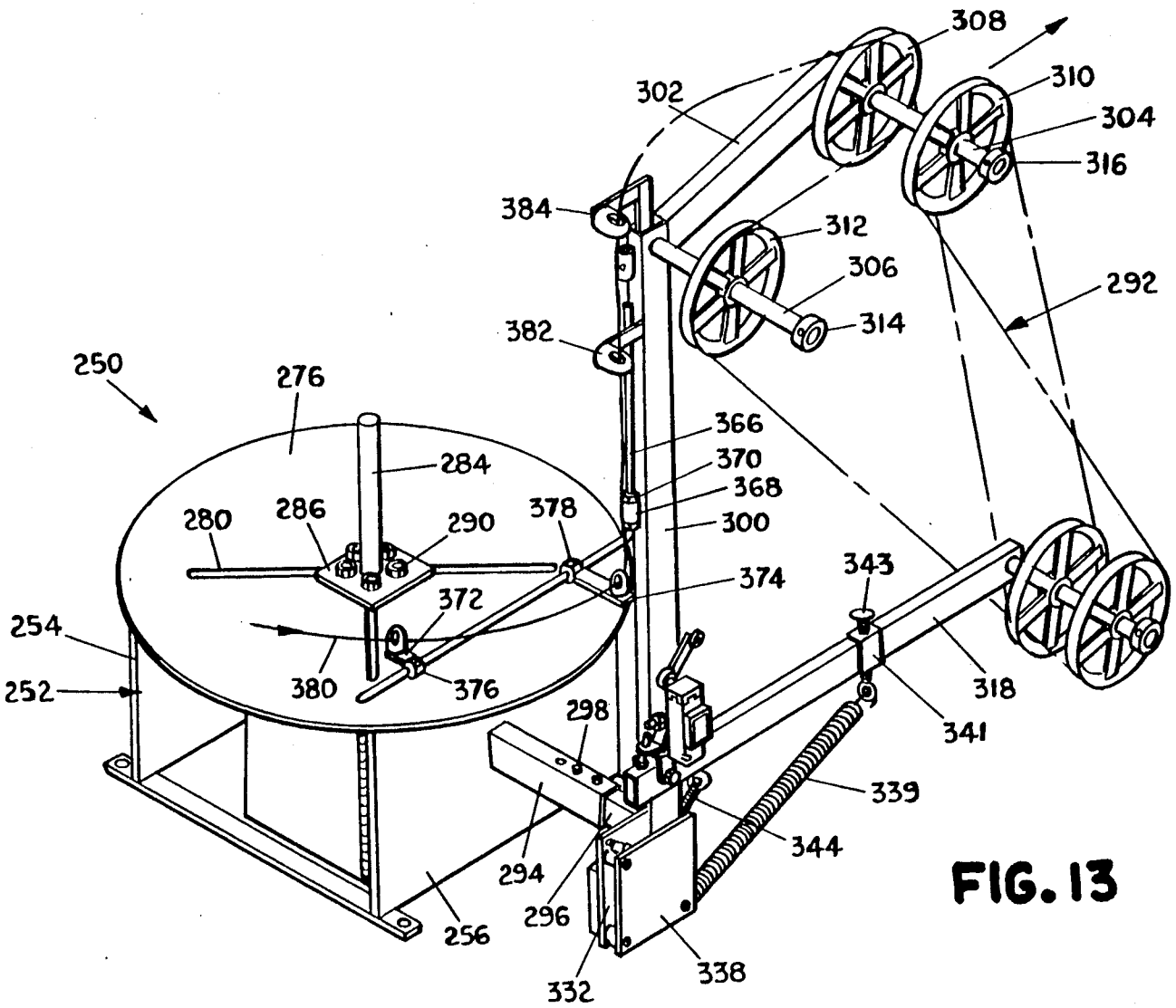
FIG. 13 is a perspective view of another embodiment of the present invention.
Figure 14:
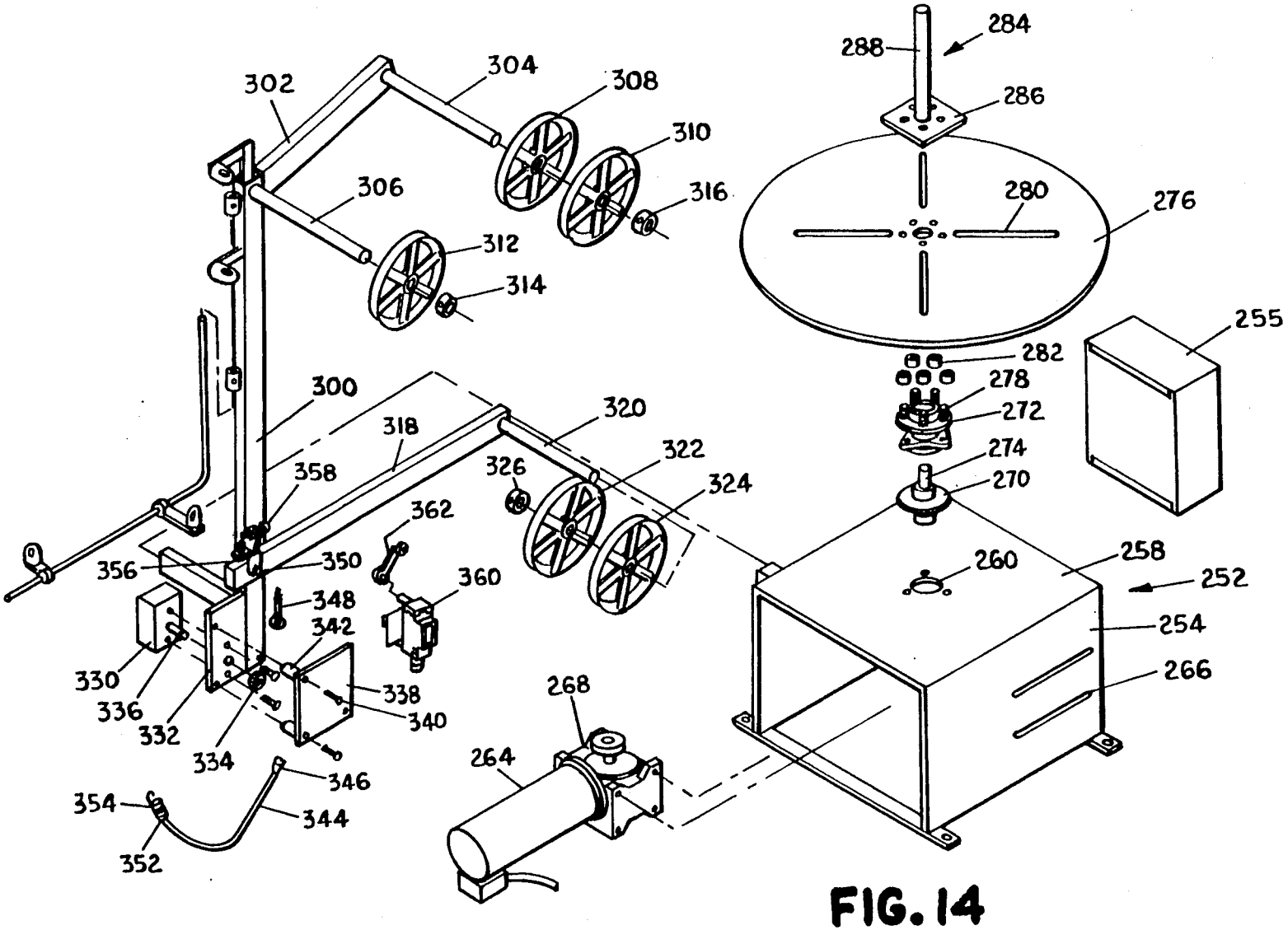
FIG. 14 is an exploded perspective view of the FIG. 13 embodiment.

Referring to the embodiment shown in FIGS. 13 and 14, wire dereeler 250 comprises a base 252 having spaced vertical sides 254 and 256, with a top 258 extending between the sides. The top has an opening 260 therethrough for the drive mechanism. A one-half (½) horse power drive motor 264 of the same type employed in the previous embodiments is bolted in the interior of the housing in slots 266 in vertical sidewall 254. The slots permit horizontal adjustment of the drive motor position. A controller 255 of the same type used for the previous embodiments is attached to the housing. A right angle gear mechanism and drive sprockets 268 are attached to the output shaft of the drive motor. The drive sprockets drivingly engage a drive sprocket 270 through opening 260. A table bearing 272 is bolted to the top of the housing over opening 260, such that a drive shaft 274 driven by the drive sprockets extends through the table bearing. The table bearing can be a conventional automobile wheel bearing. A round table 276 is mounted on bolts 278 extending upwardly from the table bearing. Four radial slots 280 extend outwardly in the table from the center at spaced intervals about the table. Spacers 282 properly space the table above the table bearing.

When a spool of wire is placed on the table, a central table stem 284 comprising a flat base 286 and a vertical axle shaft 288 is mounted on the top of the table. The stem is attached to the table and bearings by bolts 278 and nuts 290. A spool of wire is laid flat on the stem and is rotated by the table in a counter-clockwise direction (FIG. 13 orientation).

Wire is dispensed from the spool by means of a wire dispensing mechanism 292, which operates in a manner similar to the previous embodiments. Wire dispensing mechanism 292 is mounted on a support beam 294 extending outwardly from the side of the housing. The support beam is a hollow, rectangular beam. The support beam is extendable by a telescoping beam 296 mounted in the end of beam 294. Set screws 298 hold the control mechanism in any desired position. The telescoping mounting beam is provided so that the wire dispensing mechanism does not interfere with wire spools or other containers that may be of an unusually large diameter.

A vertical support arm 300 is attached to the outer end of beam 296 and extends upwardly to an upper end. An outwardly and upwardly inclined arm 302 is attached to the upper end of arm 300. Axles 304 and 306 are mounted at the outer and inner ends of arm 302, and reels or pulleys 308, 310 and 312 are mounted rotatably on the axles, secured on the axles by collars 314 and 316. A lower pivotable arm 318 extends outwardly from a lower position on arm 300, and a single axle 320 extends outwardly from the end of lower arm 318.

Pulleys or reels 322 and 324 are mounted on the axle 320 and secured in place by collar 326. A potentiometer 330 is mounted on the inner side of a plate 332 attached at the lower end of arm 300, and a gear 334 is mounted on the output shaft 336 of the potentiometer on the other side of the plate. Another plate 338 is mounted over gear 334 by bolts 340 and spacers 342. A timing belt 344 has one end 346 attached to an eye bolt 348, which is in turn attached to arm 318 at a point spaced away from an axle bolt 350 whereby arm 318 is pivotally mounted to arm 300 for upward rotation. The other end 352 of the timing belt is attached by a return spring 354 to a bolt or spacer 342 on the fixed position members of the mechanism. Stop bolts 356 and 358 limit the pivotal movement of arm 318 between upper and lower pivotal positions. A limit switch 360 actuated by a pivoting cam arm 362 is mounted to arm 300 in such a position that pivoting arm 318 actuates the limit switch if, for some reason, the arm is pivoted upward to its maximum position. The limit switch can then deactuate the wire using device that is connected to the dereeler.

Coil spring 339 extending from plate 338 to a yoke or collar 341 slidably mounted on arm 318 urges the arm downwardly. The yoke can be repositioned by loosening and retightening lock bolt 343 to change the tension on the arm.

Wire is routed from the horizontal rotating table to the speed control mechanism 292 by means of a right angle control rod 366 rotatably mounted on arm 300 by vertical sleeve 368 and held in place in the sleeve by collar 370. A horizontal section of rod 366 has a pair of wire guide fittings 372 and 374 attached to the rod by collars 376 and 378. The wire guide fittings comprise porcelain eyes mounted on mounting plates extending outwardly from the collars. The porcelain eyes serve as a convenient, low friction guide for directing wire from the horizontal spool upwardly to the pulley mechanism in a smooth curved path that minimizes deflection of the wire. Wire 380 coming from the spool extends through the porcelain eyes of wire guides 372 and 374 and then extends upwardly through additional wire guides 382 and 384 mounted toward the upper end of arm 300. After passing through wire guide 384, the wire is then looped around the pulleys in the same manner as the previous embodiments. The pulleys may be shifted from axle to axle and the wire may be wound around the pulleys in any desired configuration in order to position wire at a desired height or dispense wire in a given direction. One possible way of winding the wire around the pulleys is shown in FIG. 13.

In operation, the embodiment of FIG. 13 operates in substantially the same way as in previous embodiments. Swing rod 366 pivots inwardly as wire is dispensed from the spool and causes a smooth transition of wire from the reel through the porcelain eyes to the pulley mechanism. The porcelain eyes provide an inexpensive yet effective and efficient low-friction guide mechanism for directing wire from the horizontal spools to the vertically oriented pulleys.

Figure 16:
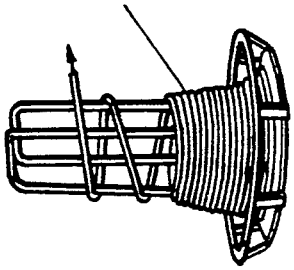
FIG. 16 is a perspective view of a stem or catchway coil of wire.
Figure 17:
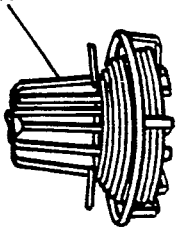
FIG. 17 is a perspective view of a basket of wire.
Figure 18:
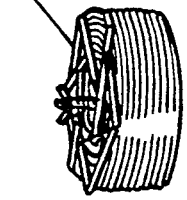
FIG. 18 is a perspective view of a loose pack of wire.
Figure 19:
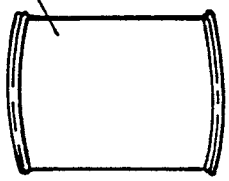
FIG. 19 is a perspective view of a tub containing loose pack wire.
Figure 20:
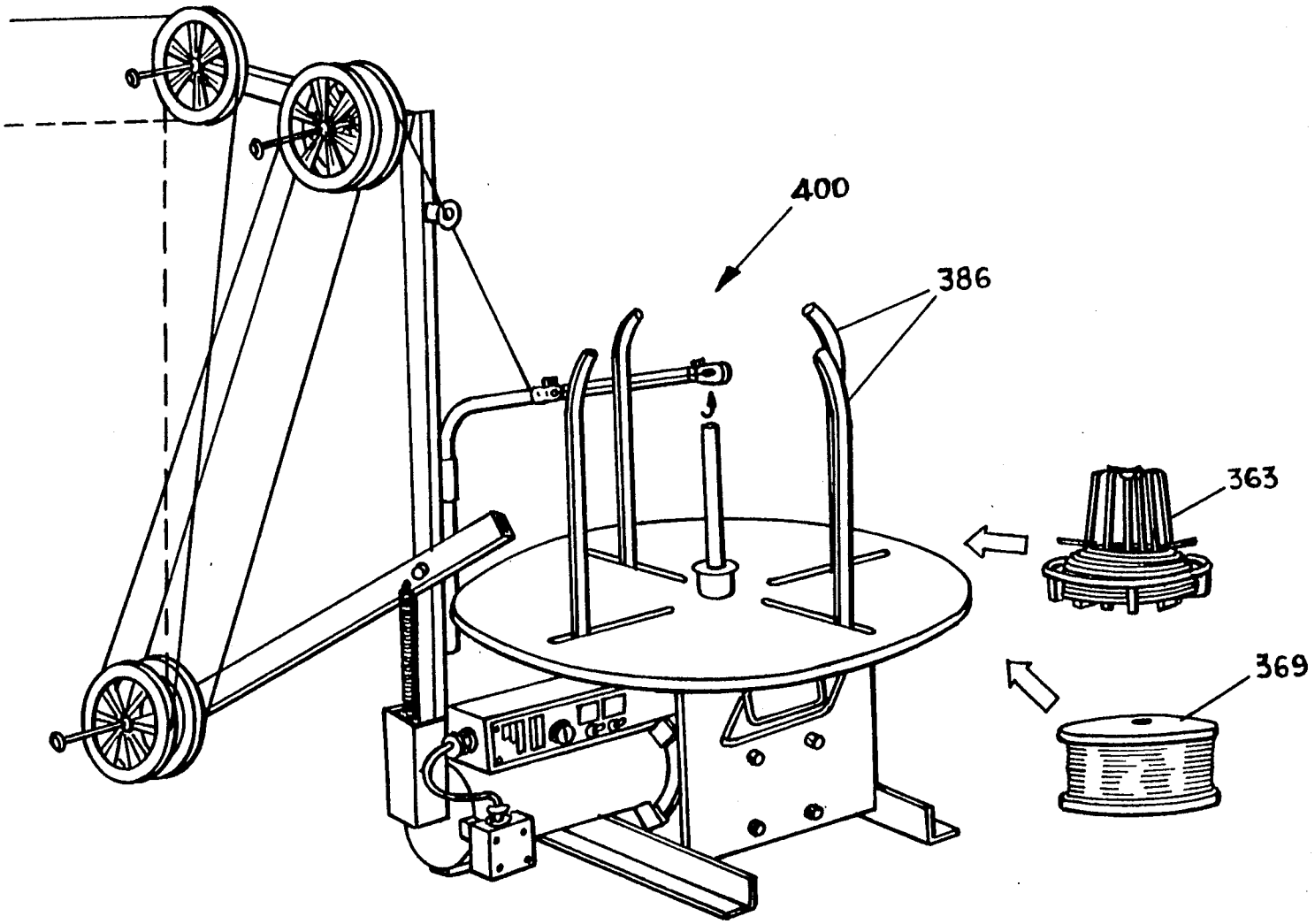
FIG. 20 is a perspective view of the embodiment shown in FIG. 15.

In addition to spools of wire, four types of wire storage systems are disclosed in FIGS. 16–19. A stem or catchway coil 361, which is used to carry wire weighing up to 1200 pounds is shown in FIG. 16. A basket of wire 363 is shown in FIG. 17. Loose-packed wire 365 is shown in FIG. 18, and a tub 367 in which loose-packed may be packed is shown in FIG. 19. A spool of wire 369 is shown in FIG. 20.

Different types of adapters can be employed on rotating table 276 in order to accommodate different types of wire. When loose wire is mounted on the table, for example, vertical spool guide rods 386 may be mounted at adjustable locations in slots 280, as shown in FIG. 20.

Figure 15:
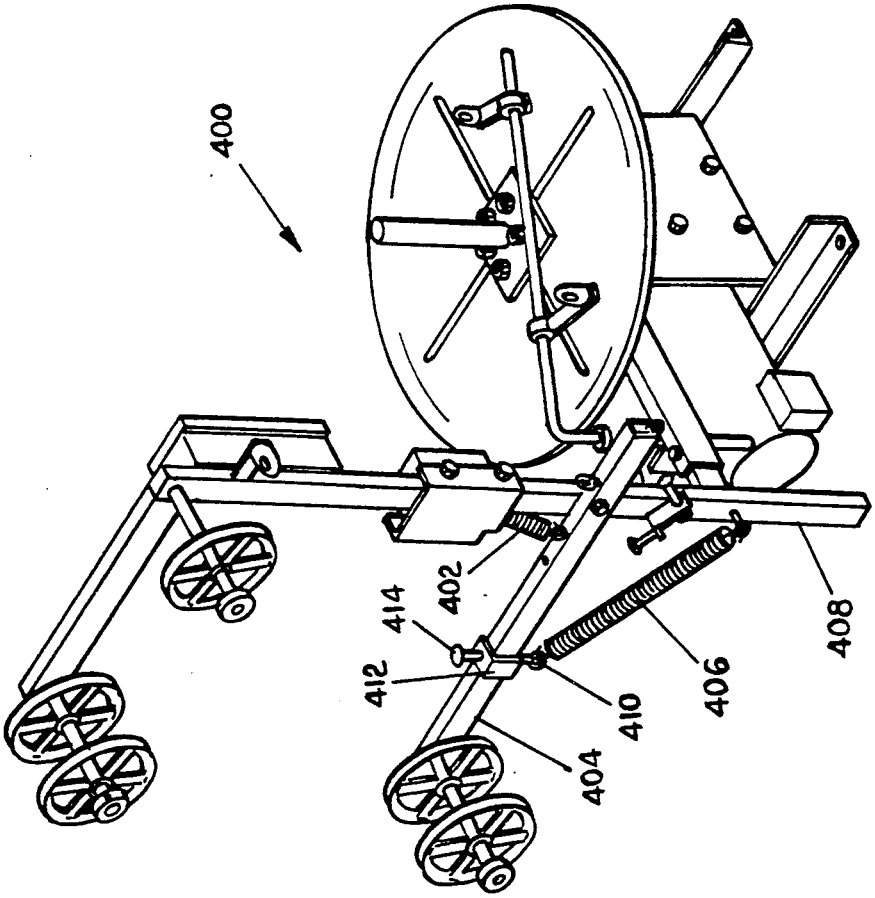
FIG. 15 is a perspective view of still another embodiment of the present invention.

Another embodiment of the present invention as particularly designed for light wire is shown in FIG. 15. In this figure, wire dereeler 400 is of similar construction to wire dereeler 250 and will not be described herein. To accommodate fine wire, in this embodiment, an upwardly biased spring 402 attached to pivotal control arm 404 at an upper side urges the arm upwardly, while another coil spring 406 extending from a lower portion of vertical arm 408 to the under side of arm 404 urges the arm downwardly. The difference in biasing forces provided by upwardly urging spring 402 and downwardly urging spring 404 determines a net biasing force which makes arm 404 either seem heavier or lighter to the adjustment mechanism. When spring 402 exerts a rotational force greater than spring 406 (partially overcoming the gravity effect of the weight of arm 404), arm 404 pivots upwardly with less wire tension than an unbiased arm. This makes the mechanism more sensitive. When the downward pivotal force of spring 406 exceeds the upward pivotal force of spring 402, arm 404 is less sensitive than an unbiased arm. An upper end 410 of spring 406 is attached to a yoke or channel bracket 412 than rides along arm 404. The channel bracket can be slid inwardly and outwardly on arm 404 and locked in any desired place by lock bolt 414 in order to vary the downward force of spring 406. This permits adjustment of the mechanism for any particular type of wire.

In all other respects, wire dereeler 400 functions substantially the same as wire dereeler 250.

Figure 21:
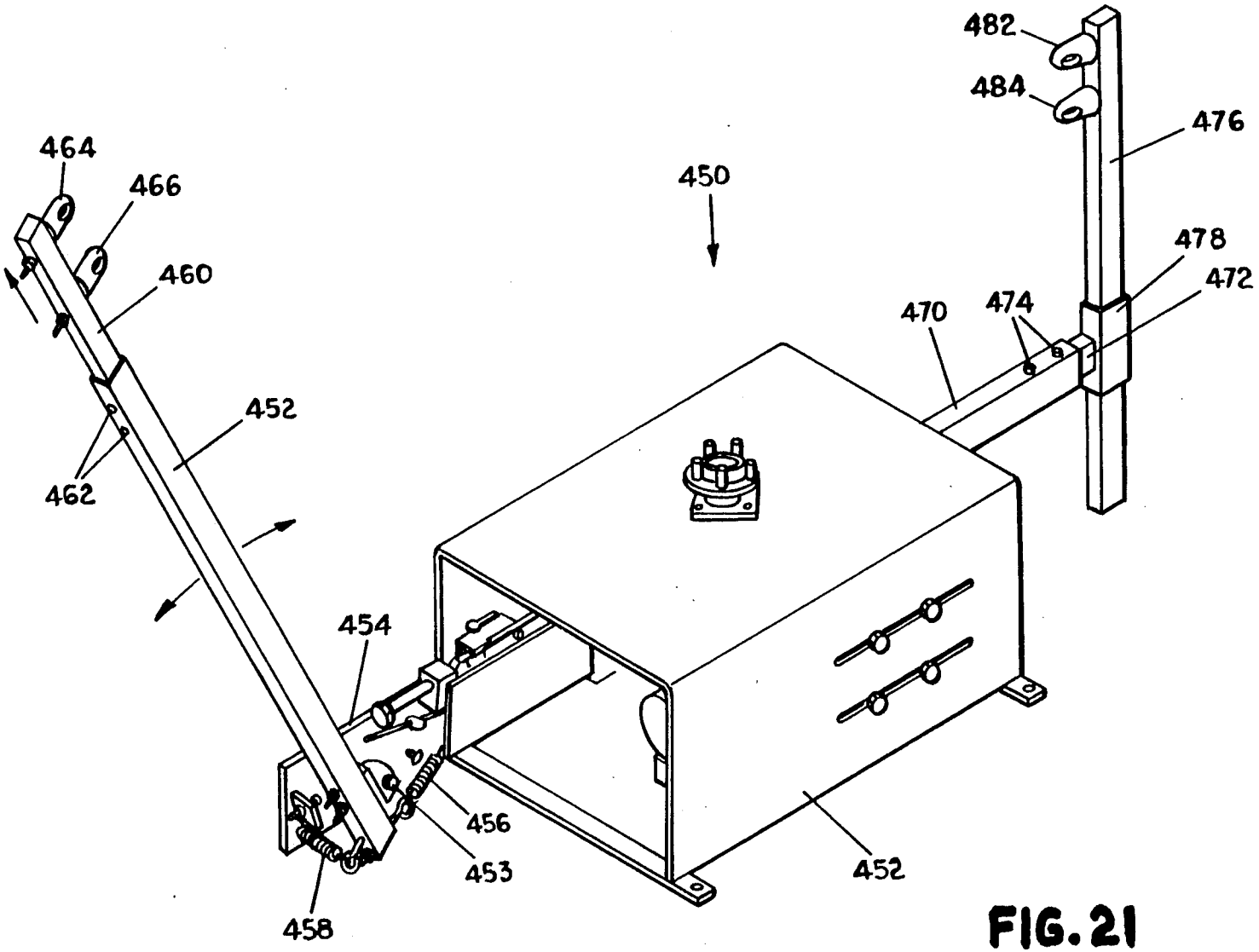
FIG. 21 is a perspective view of another embodiment of the present invention.
Figure 22:
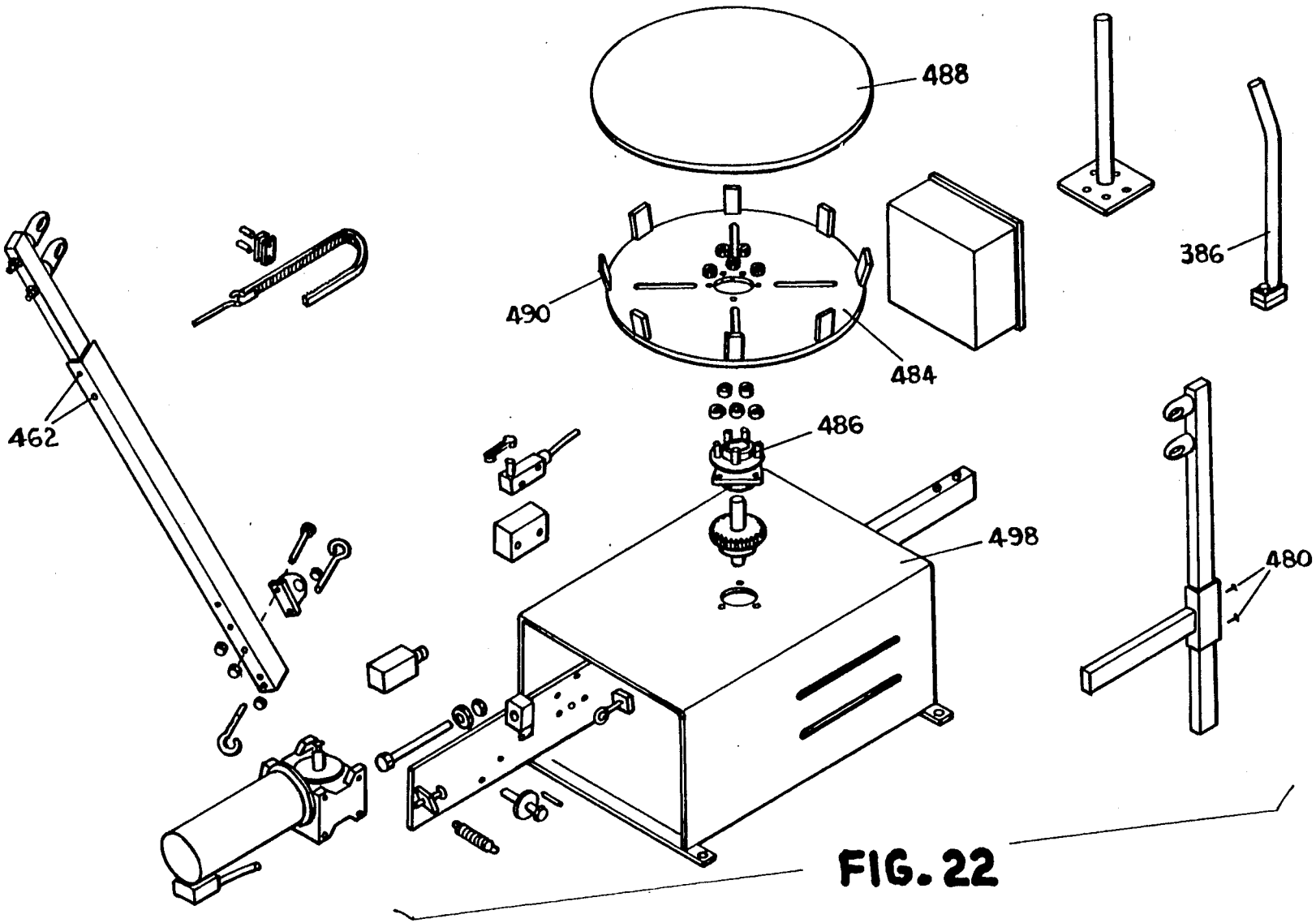
FIG. 22 is an exploded perspective view of the embodiment of FIG. 21.

A slightly different embodiment of a horizontal wire dereeler is shown in FIG. 21. In this figure, dereeler 450 has a channel shaped gusset or base 452 similar in configuration of the housing of dereeler 250. In this embodiment, however, the pivoting control arm 452 that controls the operation of the drive motor is mounted for rotation in a vertical plane about an axle 453 mounted in vertical mounting plate 454. The motor control components are substantially the same as described previously, however, although their positions are changed somewhat to affect the different position of mounting.

Figure 23:
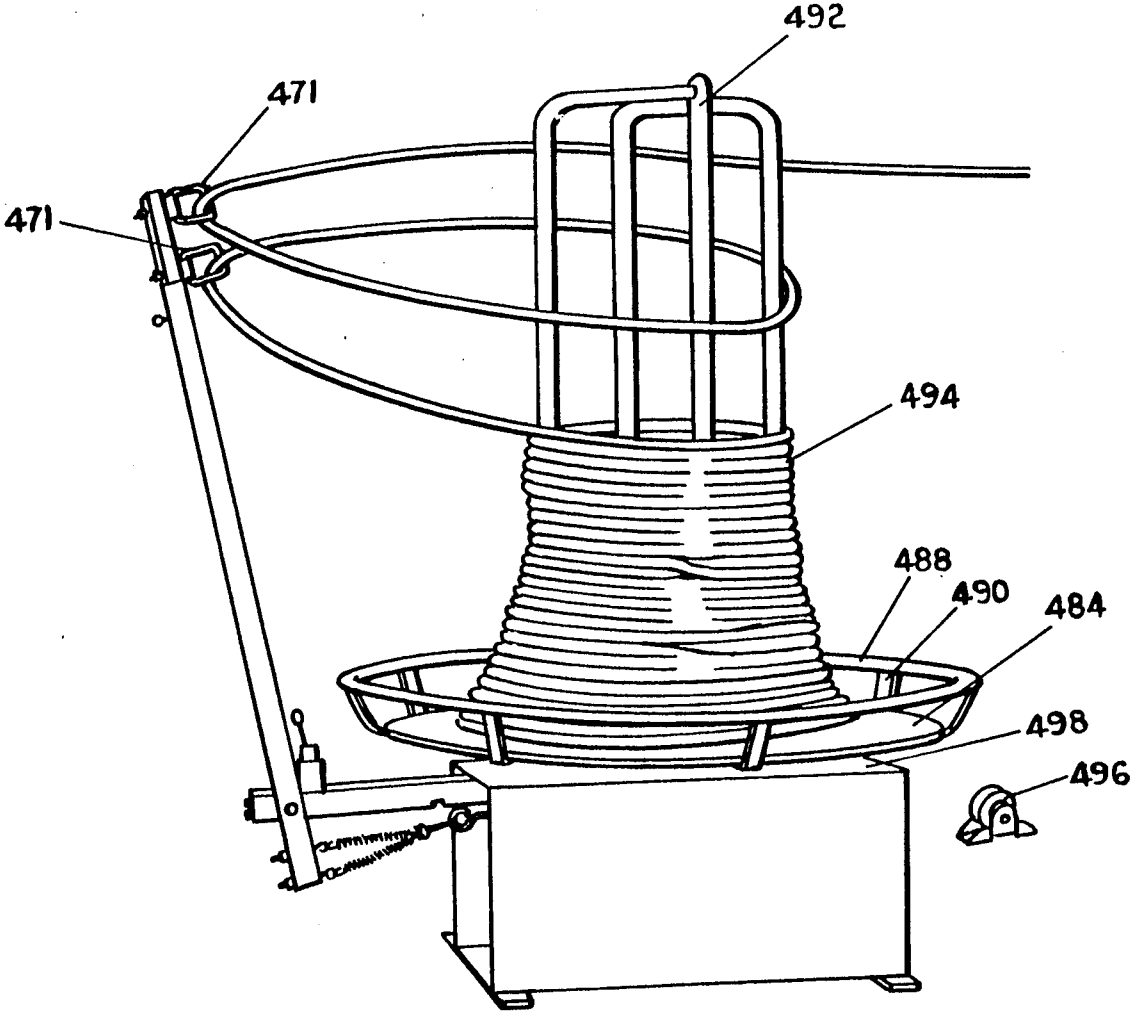
FIG. 23 is a perspective pictorial view of the embodiment of FIG. 21.

Arm 252 in its rest state is inclined rearwardly and is biased in that direction by return spring 456. Opposite acting spring 458 attached to the lower end of arm 452 can be employed to increase the sensitivity of the control mechanism. Arm 452 has a telescoping outer section 460 held in position by set screws 462. Eyes 464 and 466 are mounted on outer arm 460 for guiding wire from the horizontal wire platform. Arm 460 can be telescoped into and out of arm 452 in order to accommodate wire storage devices of different sizes. In addition, as shown in FIG. 23, instead of porcelain eyes, one or more rectangular shaped wire guides 471 can be used at the outer end of arm 460 in order to dispense flat wire. A rectangular member several inches wide can be used to dispense coils of wire sheet in strip form.

An arm 470 extends out of the opposite end of housing 452 in a horizontal direction and includes an outer telescoping section 472 attached by set screws 474 to arm 470. Again, arm 472 can be moved inwardly and outwardly to accommodate wire storage units of different size. A vertical arm 476 is mounted in a channel member 478 at the outer end of arm 472 and is held in place at any desired vertical position by means of set screws 480. Porcelain eyes 482 and 484 are mounted at the upper end of arm 476 for guiding wire.

When a stem or catchway coil is employed, a table 484 is mounted on the table bearing 486. A round ring 488 is mounted on spaced peripheral flanges 490 positioned around the outer edge of table 484. A metal frame 492 is mounted on the middle of the table and serves as the core for wire 494.

The wire can be dispensed from dereeler 450 by extending the wire between eyes 464 and 466 and eyes 482 and 484. Alternatively, it is even possible to dispense wire without the use of arm mechanism 476, in the manner shown in FIG. 23. For an extremely heavy wire spool, three additional table support rollers 496 can be mounted on the top of housing 498 so as to support the underside of table 484.

With the foregoing horizontal dereelers, a wide variety of wire and spring sizes, both round and flat, can be dispensed from a single machine. This provides a substantial amount of versatility to the dereeler. This also can result in considerable cost efficiency, since bulk wire and wire packaged loosely sometimes is less expensive than wire provided on spools.

It should be understood that the foregoing embodiments of the present invention are merely exemplary of the preferred practice of the invention and the various modifications and changes may be made in these embodiments without departing from the spirit and scope of the present invention.

The embodiments of the present invention in which an exclusive property or privilege is claimed are defined as follows:

1. A variable speed, motorized wire dispenser for automatically dispensing wire from a coil of wire to a wire using machine under variable wire feed rate conditions comprising:

a frame including support means for rotatably supporting the coil of wire for dispensing wire to the wire using machine in a predetermined direction, the frame comprising a wire support member rotatably mounted thereon, the coil of wire being coaxially supported on the member for rotation therewith;

an electric motor mounted in the frame so as to rotate the coil of wire;

a regenerative controller that produces an electrical output that controls the operation of the electric motor and causes the motor to both accelerate and decelerate the wire coil, the regenerative controller producing forward and reverse torques in the electric motor that automatically vary such that the speed of the motor is changed at predetermined acceleration and deceleration rates;

wire accumulation means mounted in the frame for producing an accumulation loop of wire to supply or store wire under rapidly changing demand conditions, the wire accumulation means comprising a wire engaging guide movably positioned in the frame such that wire extends over the guide in extending from the wire coil to the predetermined direction, the guide being movable in relation to the predetermined direction so as to produce an accumulation loop in the wire, the guide being biased to increase the accumulation loop between predetermined limits; and control means responsive to the position of the guide for generating a continuously variable electric control signal representative of guide position, the control means changing the control signal gradually as the loop size increases and decreases, the control signal being transmitted to the regenerative motor controller so as to produce a change in motor speed at a rate representative of the rate of change of the control signal, the control means causing the motor to decrease the rate of wire feed as wire supply requirements decrease and increase the rate of wire feed as wire supply requirements increase, the rate of change in the control signal resulting from guide movement being more gradual than the rate of change in wire feed from the wire dispenser, the accumulation loop being sufficiently large that the rate of motor acceleration and deceleration caused by the regenerative controller is gradual enough to minimize damage to the drive components and to restrain the wire from jumping off the guide.

2. A variable speed, motorized wire dispenser for automatically dispensing wire from a coil of wire to a wire using machine under variable wire feed rate conditions comprising:

a frame including support means for rotatably supporting the coil of wire for dispensing wire to the wire using machine in a predetermined direction, the frame comprising a wire support member rotatably mounted thereon, the coil of wire being coaxially supported on the member for rotation therewith;

an electric motor mounted in the frame so as to rotate the coil of wire;

a regenerative controller that produces an electrical output that controls the operation of the electric motor and causes the motor to both accelerate and decelerate the wire coil, the regenerative controller producing forward and reverse in the electric motor that automatically vary such that the speed of the motor is changed at predetermined acceleration and deceleration rates;

wire accumulation means mounted in the frame for producing an accumulation loop of wire to supply or store wire under rapidly changing demand conditions, the wire accumulation means comprising a wire engaging guide movably positioned in the frame such that wire extends over the guide in extending from the wire coil to the predetermined direction, the guide being movable in relation to the predetermined direction so as to produce an accumulation loop in the wire, the guide being biased to increase the accumulation loop between predetermined limits;

control means responsive to the position of the guide for generating a continuously variable electric control signal representative of guide position, the control means changing the control signal gradually as the loop size increases and decreases, the control signal being transmitted to the regenerative motor controller so as to produce a change in motor speed at a rate representative of the rate of change of the control signal, the control means causing the motor to decrease the rate of wire feed as wire supply requirements decrease and increase the rate of wire feed as wire supply requirements increase, the rate of change in the control signal resulting from guide movement being more gradual than the rate of change in wire feed from the wire dispenser, the accumulation loop being sufficiently large that the rate of motor acceleration and deceleration caused by the regenerative controller is gradual enough to minimize damage to the drive components and to restrain the wire from jumping off the guide; and said wire being guided from the coil to the wire accumulation means by porcelain eyes having openings therein that the wire fits easily through, the porcelain eyes being mounted in the dispenser at locations such that they guide the wire to the accumulation means in a curved path that minimizes friction and wire bending.

3. A wire dispenser according to claim 2 wherein the porcelain eyes are mounted on support arms that are adjustably movable toward and away from the wire support member such that the dispenser can accommodate wire coils of different sizes without having said arms interfere with the rotation of the wire coil.

4. A wire dispenser according to claim 1, wherein the wire accumulation means further includes a fixed position guide spaced apart from the movable guide, the movable guide being movable toward the fixed position guide, the wire passing over both the fixed position and movable guides so as to form an accumulation loop in the wire.

5. A wire dispenser according to claim 4, wherein the fixed and movable guides are mounted respectively on fixed and pivotable control arms mounted in the frame, the control means being responsive to pivotal movement of the pivotable control arm.

6. A wire dispenser according to claim 5, wherein the control means comprises a potentiometer having a rotatable shaft with a pulley thereon that is rotated by a drive belt drivingly connected to the pivotable control arm.

7. A wire dispenser according to claim 5, wherein the fixed and pivotable control arms each have at least two guides mounted thereon, such that there are at least two accumulation loops in the wire.

* * * * *

UNITED STATES PATENT AND TRADEMARK OFFICE

CERTIFICATE OF CORRECTION

PATENT NO. : 5,100,074

DATED : March 31, 1992

INVENTOR(S) : Johnnie L. Jones

It is certified that error appears in the above-identified patent and that said Letters Patent is hereby corrected as shown below:

Column 1, line 39:
"t-o" should be --to--.

Column 7, line 12:
After "motor 51" insert --.--.

Column 14, line 67:
After "surface" insert --.--.

Column 15, line 13:
After "extends" insert --.--.

Column 20, claim 2, line 39:
After "reverse " insert --torques--.

Signed and Sealed this

Fifth Day of October, 1993

Bruce Lehman

*Attest:*

BRUCE LEHMAN

*Attesting Officer*

*Commissioner of Patents and Trademarks*